US007334878B2

(12) United States Patent
Eguchi et al.

(10) Patent No.: US 7,334,878 B2
(45) Date of Patent: Feb. 26, 2008

(54) LIQUID EJECTION HEAD AND LIQUID EJECTION APPARATUS

(75) Inventors: Takeo Eguchi, Kanagawa (JP); Shogo Ono, Kanagawa (JP); Takaaki Miyamoto, Kanagawa (JP); Kazuyasu Takenaka, Tokyo (JP)

(73) Assignee: Sony Corporation, Tokyo (JP)

( * ) Notice: Subject to any disclaimer, the term of this patent is extended or adjusted under 35 U.S.C. 154(b) by 335 days.

(21) Appl. No.: 11/218,221

(22) Filed: Sep. 1, 2005

(65) Prior Publication Data

US 2006/0055735 A1 Mar. 16, 2006

(30) Foreign Application Priority Data

Sep. 8, 2004 (JP) ..... 2004-260449

(51) Int. Cl.
*B41J 2/05* (2006.01)

(52) U.S. Cl. ..... 347/56; 347/61

(58) Field of Classification Search ..... 347/56, 347/61

See application file for complete search history.

(56) References Cited

U.S. PATENT DOCUMENTS 5,208,605 A * 5/1993 Drake ..... 347/15
6,520,626 B1 * 2/2003 Murakami ..... 347/56
2004/0012649 A1 1/2004 Eguchi et al.

FOREIGN PATENT DOCUMENTS

EP 1 356 938 10/2003
JP 2004-216601 8/2004

* cited by examiner

*Primary Examiner*—An H. Do
(74) *Attorney, Agent, or Firm*—Robert J. Depke; Rockey, Depke & Lyons, LLC.

(57) ABSTRACT

A liquid ejection head includes a plurality of liquid ejection elements arrayed in a flat area on a substrate. Each liquid ejection element includes a liquid chamber, a heating element disposed in the liquid chamber, and a nozzle. The heating elements are disposed alternately on a first and second lines spaced by δ in a zigzag fashion. Each liquid chamber is formed to have a U-like shape in horizontal cross section such that a wall thereof surrounds three sides of a heating element disposed in each liquid chamber. A gap Wx is formed between each two adjacent liquid chambers located on the second line, and a gap Wy is formed between the liquid chambers located on the first line and the liquid chambers located on the second line. The gaps Wx serve as first common flow channels, and the gap Wy serves as a second common flow channel.

7 Claims, 13 Drawing Sheets

LIQUID EJECTION HEAD AND LIQUID EJECTION APPARATUS

CROSS REFERENCES TO RELATED APPLICATIONS

The present invention contains subject matter related to Japanese Patent Application JP 2004-260449 filed in the Japanese Patent Office on Sep. 8, 2004, the entire contents of which are incorporated herein by reference.

BACKGROUND OF THE INVENTION

1. Field of the Invention

The present invention relates to a thermal liquid ejection head used in an ink-jet printer head or the like, and also to a liquid ejection apparatus such as an ink-jet printer using a liquid ejection head. More specifically, the present invention relates to a technique to realize a structure for supplying liquid with minimized ejection variations.

2. Description of the Related Art

One known liquid ejection head for use in a liquid ejection apparatus such as an ink-jet printer is a thermal liquid ejection head which operates using expansion and contraction of a generated bubble.

In this thermal liquid ejection head, heating elements are disposed on a semiconductor substrate, and bubbles are generated in liquid chambers by heating elements, thereby ejecting liquid droplets from nozzles disposed on the respective heating elements toward a recording medium.

FIG. 12 is a perspective view showing the appearance of a liquid ejection head 1 of the above-described type (hereinafter, referred to simply as the head 1). In FIG. 12, the nozzle sheet 17 formed on the barrier layer 3 is shown in the form of an exploded view.

FIG. 13 is a cross-sectional view showing the flow channel structure of the head 1 shown in FIG. 12. The flow channel structure of the liquid ejection apparatus of this type is disclosed, for example, in Japanese Unexamined Patent Application Publication No. 2003-136737.

As shown in FIGS. 12 and 13, a plurality of heating elements 12 are disposed on a semiconductor substrate 11. A barrier layer 3 is formed on the semiconductor substrate 11, and a nozzle sheet (nozzle layer) 17 is further formed thereon. Each part including a heating element 12 and a part of the barrier layer 3 formed on the semiconductor substrate 11 is referred to as a head chip 1*a*. A part including a head chip 1*a* and a nozzle 18 (nozzle sheet 17) is referred to as a head 1.

In the nozzle sheet 17, nozzles (holes via which to eject liquid droplets) 18 are formed at locations corresponding to the respective heating elements 12. The barrier layer 3 is formed on the semiconductor substrate 11 and between the heating element 12*s* and the nozzles 18*s* such that a liquid chamber 3*a* is formed between each heating element 12 and a corresponding nozzle 18.

As shown in FIG. 12, the barrier layer 3 is formed so as to have comb-like fingers, and each heating element 12 is disposed between two adjacent fingers such that three sides of each heating element 12 is surrounded by the barrier layer 3 when seen in horizontal cross section whereby each liquid chamber 3*a* is formed such that only one side is open. Each opening forms an individual flow channel 3*d* communicating with a common flow channel 23.

Each heating element 12 is disposed on the semiconductor substrate 11, at a location close to one side of the semiconductor substrate 11. As shown in FIG. 13, a dummy chip D is disposed on a left-hand side of the semiconductor substrate 11 (head chip 1*a*) such that a common flow channel 23 is formed between one side face of the semiconductor substrate 11 (head chip 1*a*) and one side face of the dummy chips D. Note that the member disposed on the left-hand side of the semiconductor substrate 11 is not limited to the dummy chip D, but another member may be used as long as the common flow channel 23 can be formed.

On the semiconductor substrate 11, as shown in FIG. 13, a flow channel plate 22 is disposed on a surface opposite to the surface on which the heating elements 12 are disposed. In this flow channel plate 22, as shown in FIG. 13, an ink supply inlet 22*a* and an ink supply flow channel (common flow channel) 24 are formed such that the ink supply flow channel 24 is substantially U shaped in cross section and such that the ink supply inlet 22*a* communicates with the ink supply flow channel 24. The ink supply flow channel 24 and the common flow channel 23 communicate with each other.

In this structure, ink is supplied via the ink supply inlet 22*a* into the ink supply flow channel 24, then into the common flow channel 23, and finally into the liquid chamber 3*a* via the individual flow channel 3*d*. A bubble is generated on the heating element 12 in the liquid chamber 3*a* by heat generated by the heating element 12, and a flight force is generated when the bubble is generated whereby the liquid (ink) in the liquid chamber 3*a* is partially ejected in the form of a liquid droplet from the nozzle 18.

Note that in FIGS. 12 and 13, the shapes of respective parts are drawn in an easily understandable manner and the drawn shapes are not necessarily exactly similar to the actual shapes. For example, the thickness of the semiconductor substrate 11 is about 600 to 650 μm, and the thickness of the nozzle sheet 17 and that of the barrier layer 3 are about 10 to 20 μm.

A first method of producing the head 1 is to bond the head chip 1*a* produced using a semiconductor process to the nozzle sheet 17 produced separately. This method is called a chip mounting method. A second method is to produce nozzles (on-chip nozzles) 18 integrally on a semiconductor substrate 11.

SUMMARY OF THE INVENTION

When the head 1 is produced by the first method, after the head chip 1*a* and the nozzle sheet 17 are separately produced, the head chip 1*a* is bonded to the nozzle sheet 17 with high registration accuracy on the order of microns. Thereafter, a heating and pressing process is performed. When the head 1 is produced by the first method described above, it is needed to control the production process very precisely. In particular, in a case in which a line head with a length equal to the width of a recording medium is produced by arraying a plurality of head chips 1*a* on the nozzle sheet 17, a slight change in a production condition can cause a significant difference in performance among head chips 1*a*, which can result in degradation in image quality.

A head may be produced by producing a through-hole for supplying ink in the center of the head chip in the longitudinal direction of the head chip, and disposing heating elements, liquid chambers, and nozzles on both sides of the through-hole and along the through-hole.

Empirically, the head of this type has less characteristic variations among head chips disposed by chip-mounting than a head produced by disposing heating elements 12 along an edge of a semiconductor substrate 11, such as a head 1 shown in FIG. 12 or 13.

However, this structure has the following problems.

(1) Employment of this structure results in an increase in the width of the head chip by a factor of about 2.

(2) A special semiconductor process is needed to produce the through-hole at the center of the head chip.

(3) The results are an increase in cost and a reduction in production yield.

On the other hand, when the head is produced by the second method described above, the problem caused by a characteristic variation due to chip-mounting does not occur. However, when a line head is produced using the second method, difficult techniques are needed to fix a large number of head chips to a frame such that head chips are arrayed with high chip-to-chip registration accuracy. Furthermore, it is difficult to equally supply liquid to all head chips. That is, the second method does not allow the line head to be produced easily with no problems.

Thus, there is a need for a technique of producing a head without creating a significant characteristic variation among head chips during a production process, and there is also a need for a flow channel structure in which substantially no bubbles are generated.

In view of the above, the present invention provides a liquid ejection head. More specifically, a liquid ejection head according to an embodiment of the invention includes a plurality of liquid ejection elements arrayed in a flat area on a substrate, each liquid ejection element including a liquid chamber for holding a liquid to be ejected, a heating element disposed in the liquid chamber, for generating a bubble in the liquid in the liquid chamber by heating the liquid, and a nozzle for ejecting the liquid in the liquid chamber when the bubble is generated by the heating element, wherein, of the plurality of heating elements, heating elements at M-th positions as measured from an end of the array of heating elements are disposed such that the center of each of these heating elements is located exactly on or close to a first line extending in the same direction as the direction in which the heating elements are arrayed, while heating elements at N-th positions as measured from the end of the array of heating elements are disposed such that the center of each of these heating elements is located exactly on or close to a second line extending in the same direction as the direction in which the heating elements are arrayed, the first and second lines being parallel with each other and being spaced from each other by δ (real number greater than 0), Ms being odd or even numbers, Ns being even numbers if Ms are odd numbers or odd numbers if Ns are even numbers, each liquid chamber is formed to have a U-like shape in horizontal cross section such that a wall thereof surrounds three sides of a heating element disposed in the liquid chamber, the heating elements are arrayed such that the heating elements disposed on or close to the first and second lines are located, as a whole of heating elements, at regular intervals of P, the liquid chambers are disposed such that an open side of each liquid chamber whose wall surrounds three sides of one of heating elements located exactly on or close to the first line faces in a direction opposite to a direction in which an open side of each liquid chamber whose wall surrounds three sides of one of heating elements located exactly on or close to the second line faces, a gap Wx (real number greater than 0) is formed at least between each adjacent liquid chambers disposed at intervals of 2P on or close to the first line or between each adjacent liquid chambers disposed at intervals of 2P on or close to the second line such that adjacent liquid chambers are spaced from each other by the gap Wx in the direction in which the liquid chambers are arrayed, a gap Wy (real number greater than 0) is formed between the liquid chambers disposed on or close to the first line and the liquid chambers disposed on or close to the second line such that the liquid chambers disposed on or close to the first line are spaced by the gap Wy from the liquid chambers disposed on or close to the second line in a direction perpendicular to the direction in which the liquid chambers are arrayed, and flow channels each having a width equal to Wx are formed by the gaps Wx, and a flow channel having a width equal to Wy is formed by the gap Wy.

In this liquid ejection head, as described above, the liquid ejection elements are arrayed in a direction along the first or second line. The first and second lines are spaced from each other by δ. Heating elements at M-th positions as measured from an end of the array of heating elements are disposed such that the center of each of these heating elements is located exactly on or close to the first line, while heating elements at N-th positions as measured from the end of the array of heating elements are disposed such that the center of each of these heating elements is located exactly on or close to the second line.

The liquid chambers are disposed such that an open side of each liquid chamber located exactly on or close to the first line faces in a direction opposite to a direction in which an open side of each liquid chamber located exactly on or close to the second line faces. A gap Wy is formed between the liquid chambers disposed on or close to the first line and the liquid chambers disposed on or close to the second line, and a flow channel having a width equal to Wy is formed by the gap Wy (note that this flow channel corresponds to a second common flow channel 23*b* according to embodiments described later). A gap Wx is formed at least between each adjacent liquid chambers disposed at intervals of 2P on or close to the first line or between each adjacent liquid chambers disposed at intervals of 2P on or close to the second line, and flow channels each having a width equal to Wx are formed by the gaps Wx (note that these flow channels corresponds to first common flow channels 23*a* according to embodiments described later).

The present invention provides the following advantages. That is, one advantage is the ability to equally supply liquid to respective liquids. Another advantage is a small variation in ejection characteristics among liquid ejection elements. For example, it is possible to achieve a very small variation in terms of ejection speed among liquid ejection elements. Furthermore, it is possible to easily supply liquid to respective liquid chambers, and it is possible to suppress the probability of occurrence of a failure due to a bubble to an extremely low level. Even if a failure due to a bubble occurs, self-recovering from the failure can easily occur.

DESCRIPTION OF THE PREFERRED EMBODIMENTS

Figure 1:
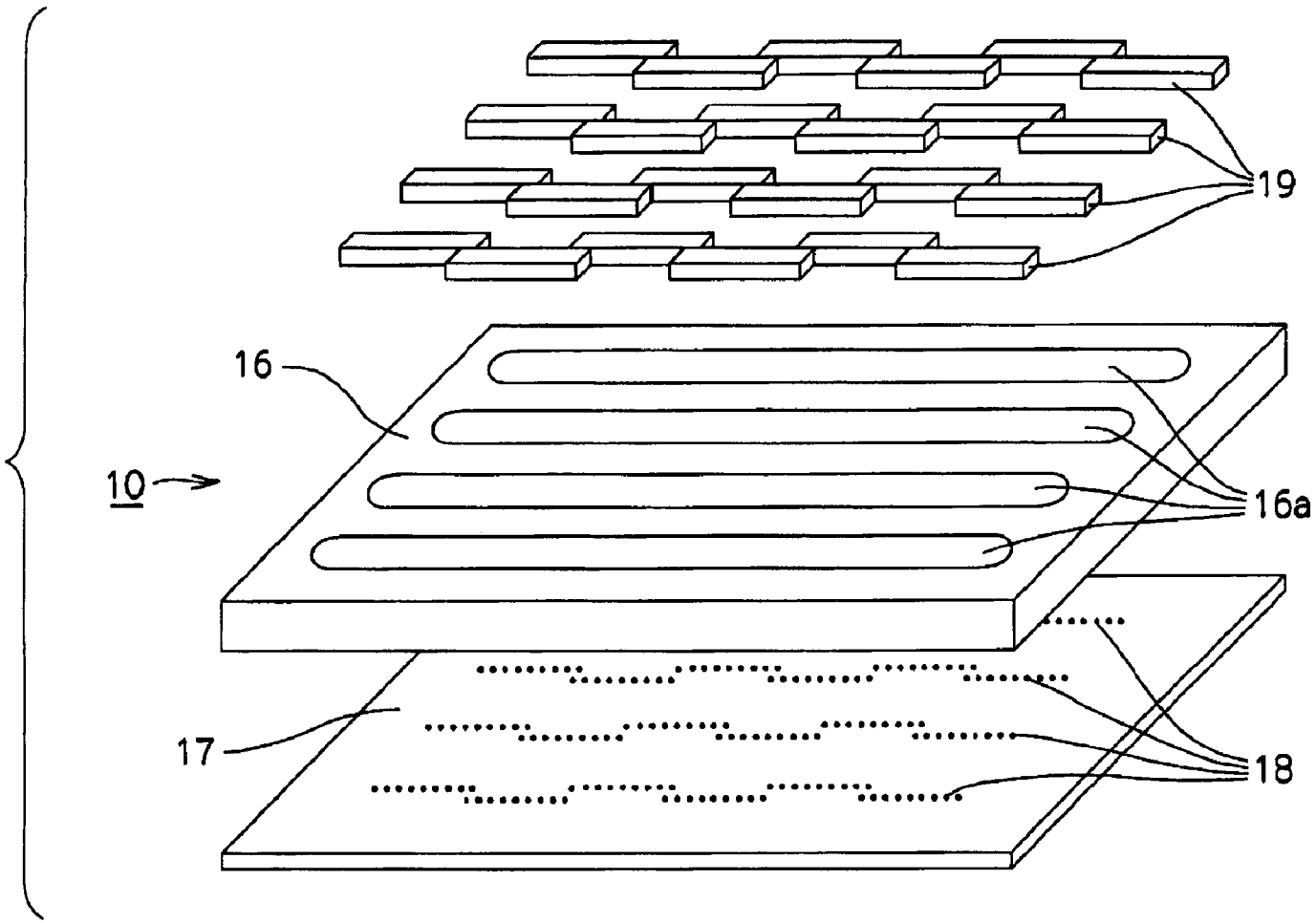
FIG. 1 is a perspective view showing the appearance of a line head according to an embodiment of the invention.

An embodiment of the present invention is described below with reference to the accompanying drawings.

The liquid ejection apparatus according to the present invention may be embodied, for example, as an ink-jet printer (a thermal color line printer (hereinafter, referred to simply as a printer)), and the liquid ejection head may be embodied as a line head 10.

In the present description, a part including a liquid chamber 13*a*, a heating element 12 (which is divided into two parts, in the present embodiment, as will be described later) disposed in the liquid chamber 13*a*, and a nozzle 18 is referred to as a liquid ejection element. The line head 10 (liquid ejection head) is formed to include an array of liquid ejection elements. A liquid ejection head is formed to include head chips 19 with nozzles 18 (nozzle sheet 17).

FIG. 1 is a perspective view showing the appearance of a line head 10 according to the present embodiment. The line head 10 includes four lines of head chips 19. Each line includes a linear array of head chips 19, and the total length of each line is equal to the width of a recording medium of the A4 size. The respective four lines of head chips 19 serve as color heads of Y (yellow), M (magenta), C (cyan), and K (black).

The line head 10 is produced by disposing a plurality of head chips 19 in a zigzag fashion on the nozzle sheet 17 (nozzle layer) and the lower surface of each head chip 19 is bonded to the nozzle sheet 17 such that each heating element 12 formed in each head chip 19 is located at a position corresponding to a nozzle 18 formed in the nozzle sheet 17.

A head frame 16 is a supporting part for supporting the nozzle sheet 17 and has a size corresponding to the size of the nozzle sheet 17. Each accommodation space 16*a* has a length corresponding to a horizontal width (21 cm) of the A4 size.

Four lines of head chips 19 are disposed in the respective accommodation spaces 16*a* of the head frame 16 such that one line of head chips 19 is disposed in one accommodation space 16*a*. Four ink tanks in which different color liquids (inks) are stored are disposed in respective accommodation spaces 16*a* of the head frame 16 and bonded to the back surface of the head chips 19 such that liquids of different colors are supplied in the respective accommodation spaces 16*a*, that is, to the respective lines of head chips 19.

Figure 2A:
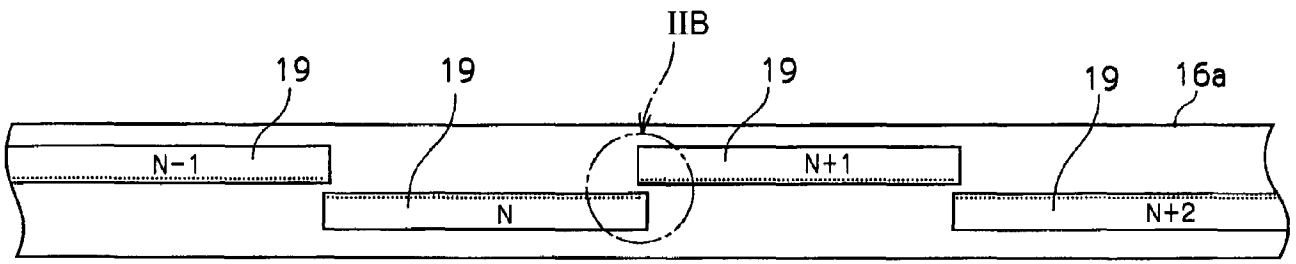
FIGS. 2A and 2B are plan views of a line of head chips.
Figure 2B:
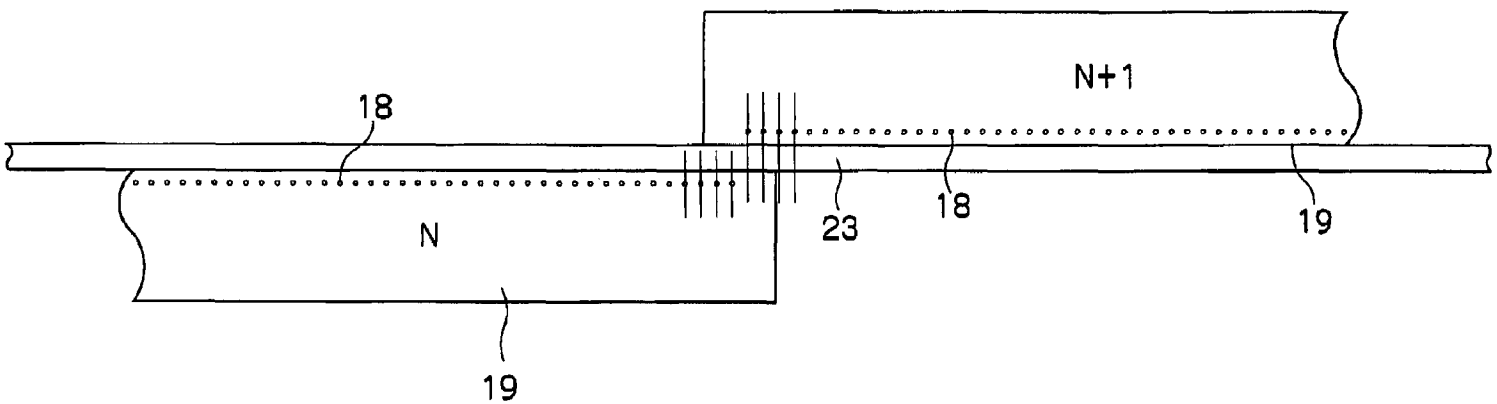

FIGS. 2A and 2B are plan views showing one line of head chips 19. Note that in FIGS. 2A and 2B, the head chips 19 and nozzles 18 are drawn in an overlapping fashion.

The head chips 19 are disposed in a zigzag form in which adjacent head chips 19 are opposite in direction to each other. As shown in FIGS. 2A and 2B, a common flow channel 23 for supplying a liquid to all head chips 19 are formed between a group of head chips 19 located at (N−1)th and (N+1)th positions and a group of head chips 10 located at Nth and (N+2)th position.

As shown in FIGS. 2A and 2B, the nozzles 18 are located at regular intervals. Note that this applies also to area where two head chips adjoin each other.

The line head 10 constructed in the above-described manner is disposed at a fixed position in the inside of the printer, and a recording medium is moved relative to the fixed line head 10 while maintaining the surface (onto which liquid droplets are fired) of the recording medium to be spaced from the liquid ejection surface of the line head 10 (the surface of the nozzle sheet 17). When the recording medium is being moved relative to the line head 10, liquid droplets are ejected from particular nozzles 18 of the head chips 19 so that dots are formed on the recording medium thereby achieving color printing of a character or an image.

The head chips 19 according to the present embodiment of the invention are described in further detail below. The head chips 19 are similar to the head chips 1*a* in that a plurality of heating elements 12 are disposed on the semiconductor substrate 11, but they are different in the manner in which the heating elements 12 are arrayed and in the shape of the liquid chambers 13*a*.

Figure 3:
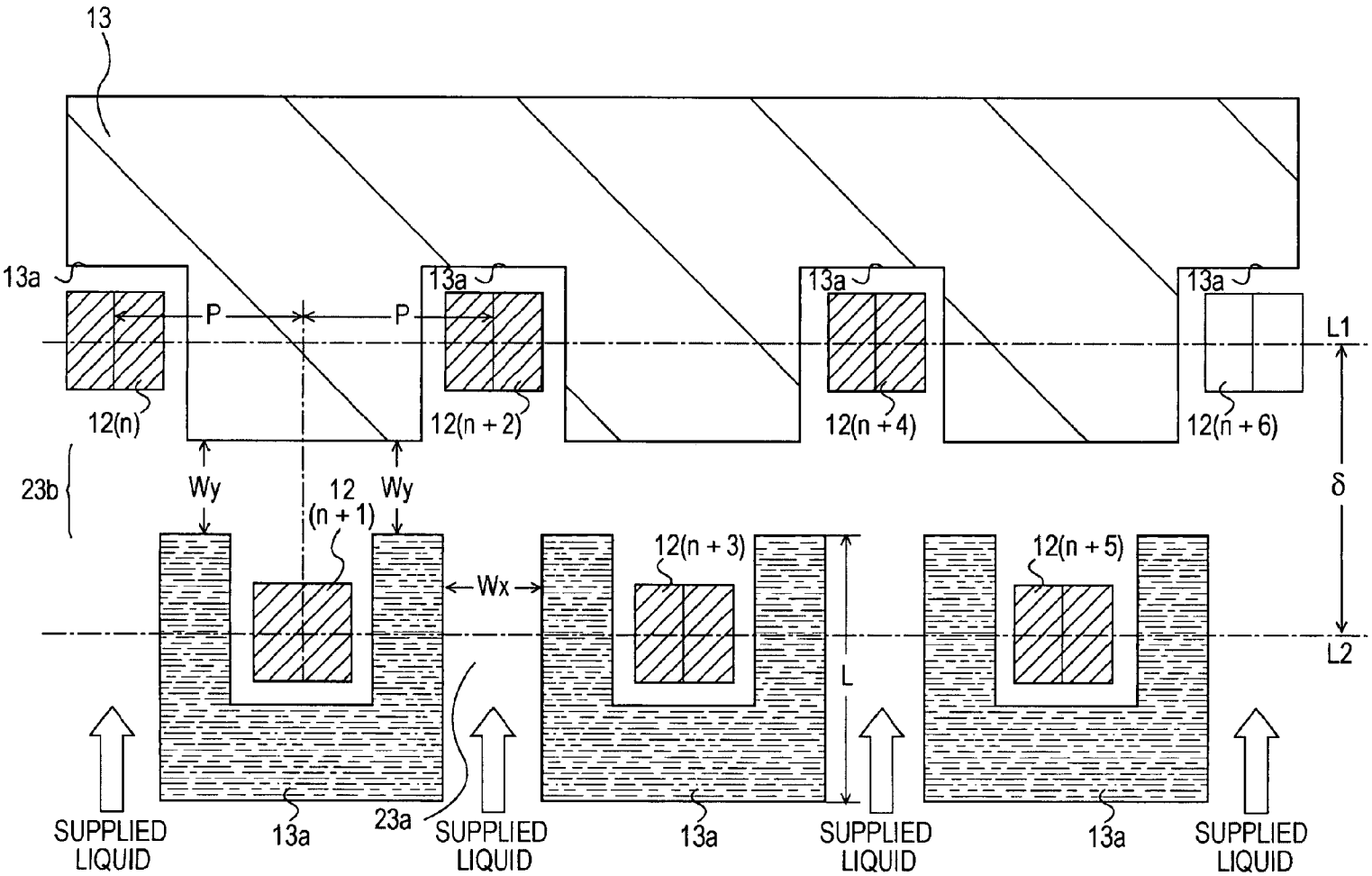
FIG. 3 is a plan view showing a form of a head chip according to an embodiment of the invention.

FIG. 3 is a plan view showing the shape of the head chip 19 according to the present embodiment.

As in the structure of the related technique, a plurality of heating elements 12 are disposed on the semiconductor substrate 11. Some of heating elements 12 (denoted by n, n+2, n+4, n+6 . . . in FIG. 3) are disposed such that the center of each of these heating elements 12 is located on a (virtual) line L1, while the other heating elements 12 (denoted by n+1, n+3, n+5, . . . in FIG. 3) are disposed such that the center of each of these heating elements 12 is located on a (virtual) line L2.

The lines L1 and L2 are parallel with each other and spaced from each other by δ (a real number greater than 0). Although not shown in FIG. 3, the lines L1 and L2 extend in parallel to and close to a longitudinal outer edge (on a lower side in FIG. 3) of the head chip 19 (the semiconductor substrate 11).

Figure 13:
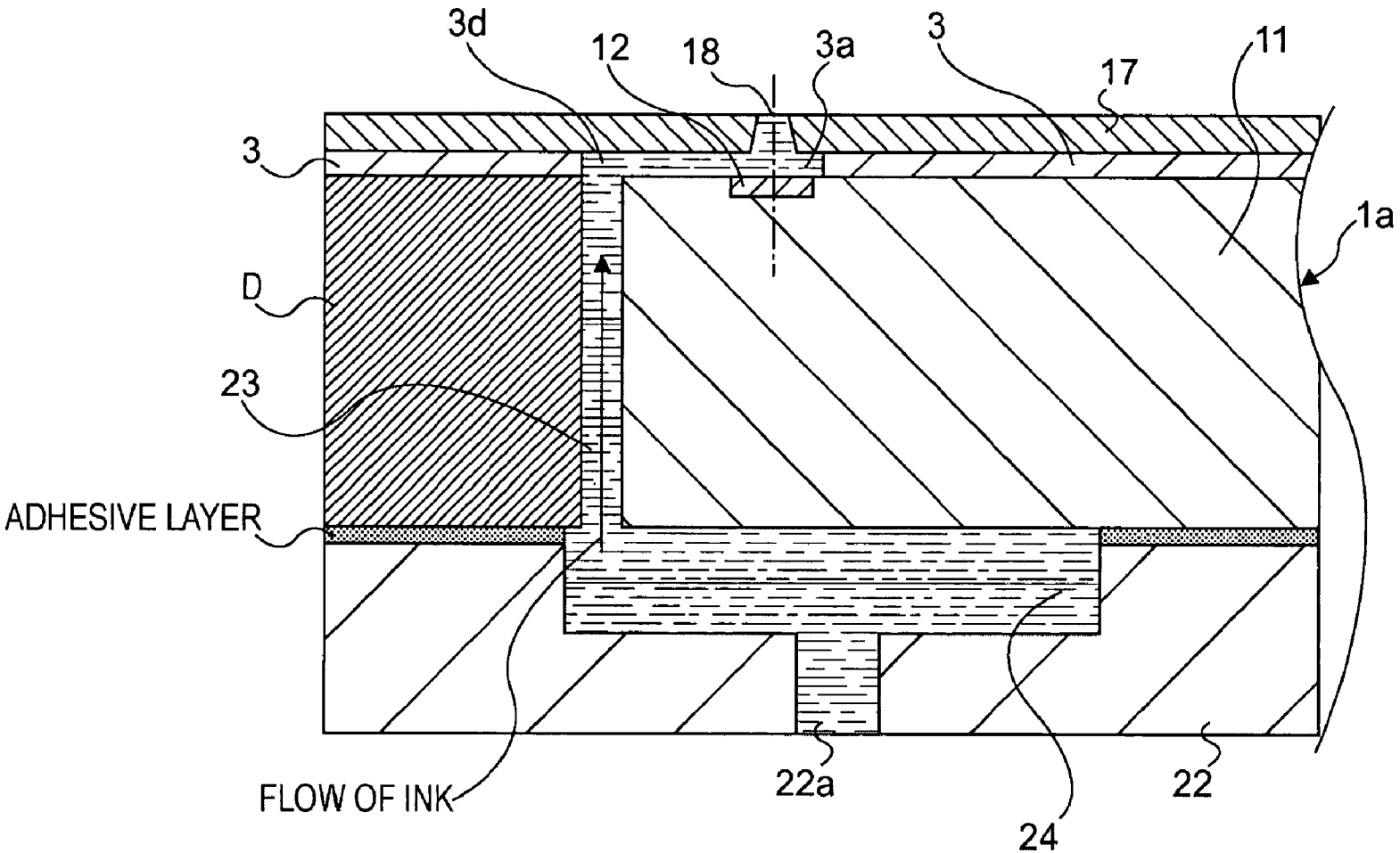
FIG. 13 is a cross-sectional view showing a flow channel structure of the head shown in FIG. 12.

Furthermore, as shown in FIGS. 2A and 2B, the common flow channel 23 for supplying the liquid to the respective liquid chambers 13*a* is formed so as to extend on the outer side of the above-described edge and along the edge of the head chip (semiconductor substrate 11). As with the common flow channel 23 shown in FIG. 13, this common flow channel 23 according to the present embodiment is formed by a side face, adjacent to the surface on which the heating element 12*s* are formed, of the semiconductor substrate 11 and by a dummy chip D or the like.

Thus, the lines L1 and L2 are parallel with the common flow channel 23 (the outer edge of the semiconductor substrate 11) and located on either side of the common flow channel 23.

Of the plurality of heating elements 12, heating elements at M-th positions as counted from one end are disposed such that the center of each of these heating elements is located on the line L1 extending in the same direction as the direction in which the heating elements 12 are arrayed (where M takes odd or even numbers). On the other hand, heating elements 12 at N-th positions as counted from the one end are disposed such that the center of each of these heating elements is located on the line L2 (where N takes even numbers when M takes odd numbers but N takes odd numbers when M takes even numbers). That is, the heating elements 12 are disposed alternately on the lines L1 and L2 in a zigzag fashion.

The heating elements 12 on the line L1 are located at intervals of 2P (2×P, and the heating elements 12 on the line L2 are also located at intervals of 2P (2×P). The position of each heating element 12 disposed on the line L1 is shifted by P relative to the position of closest one of heating elements 12 disposed on the line L2 in a direction along the direction in which the heating elements 12 are arrayed.

Thus, the heating elements 12 on the lines L1 and L2 are, as a whole, located at regular intervals of P. The interval P is determined by the resolution (DPI) of the line head 10. For example, the interval P is about 42.3 μm when the resolution is 600 DPI.

On the semiconductor substrate 11, the liquid chambers 13*a* are formed by portions of the barrier layer 13 disposed between the semiconductor substrate 11 and the nozzle sheet 17. In the example shown in FIG. 3, the liquid chambers 13*a* for the heating elements 12 located on the line L1 in FIG. 3 are formed so as to be substantially U-shaped in horizontal cross section such that three sides of each heating element 12 are surrounded by inner side walls of a corresponding liquid chamber 13*a*. The liquid chambers 13*a* are formed in the barrier layer 13 by partially cutting off the barrier layer 13 to form cutouts having a substantially U-like shape. The liquid chamber 13*a* for the heating elements 12 located on the line L1 are formed such that open sides of these liquid chambers 13*a* face the line L2.

On the other hand, the liquid chambers 13*a* for the heating elements 12 located on the line L2 are formed so as to be substantially U-shaped in horizontal cross section such that three sides of each heating element 12 are surrounded by inner side walls of a corresponding liquid chamber 13*a* and such that each liquid chamber 13*a* is isolated from the other liquid chambers 13*a*. These liquid chambers 13*a* are formed such that open sides of these liquid chambers 13*a* face the line L1.

Thus, the open sides of the liquid chambers 13*a*, in which one of the heating elements 12 located on the line L1 is disposed, face in a direction opposite to the direction in which the open sides of the liquid chambers 13*a*, in which one of the heating elements 12 located on the line L2 is disposed, face.

Note that there is no restriction on the length of the sides of each liquid chamber 13*a* in which one of heating elements 12 is located, as long as each side is longer than the length of a corresponding side of the heating element 12. In the present embodiment, each liquid chamber 13*a* is formed such that one of the heating elements 12 can be placed therein such that each inner side wall of the liquid chamber 13*a* is spaced by a few μm from the heating element 12.

A gap Wx (real number greater than 0) is formed between each adjacent two of the liquid chambers 13*a* that are located at intervals of 2P on the line L2 such that each adjacent two liquid chambers 13*a* are spaced in the direction in which the liquid chambers 13*a* are arrayed (that is, in the direction in which the line L2 extends). That is, gaps Wx are formed on both sides of each liquid chamber 13*a* such that liquid chambers 13*a* are spaced from each other in the direction in which the liquid chambers 13*a* are arrayed.

Each gap Wx serves as a first common flow channel 23*a* (with a width equal to Wx for allowing liquid to flow in a direction perpendicular to the lines L1 and L2) that is a part of the common flow channel 23 and that communicates with the common flow channel 23 for supplying liquid (ink) to each liquid chamber 13*a*.

Because the liquid chambers 13*a* on the line L1 are integrally formed in the barrier layer 13*a* (such that each liquid chamber is directly surrounded by the barrier 13), no gap Wx is formed between adjacent liquid chambers 13*a* located on the line L1.

The ends, on the side facing the line L2, of the respective liquid chambers 13*a* located on the line L1 are spaced by a gap Wy (real number greater than 0) in a direction perpendicular to the direction in which the liquid chambers 13*a* are arrayed from the ends, on the side facing the line L1, of the respective liquid chambers 13*a* located on the line L2. As with the gaps Wx, the gap Wy serves as a second common flow channel 23*b* (with a width equal to Wy for allowing liquid to flow in a direction parallel with the lines L1 and L2) that is a part of the common flow channel 23 and that communicates with the common flow channel 23 for supplying liquid (ink) to each liquid chamber 13*a*.

Figure 4:
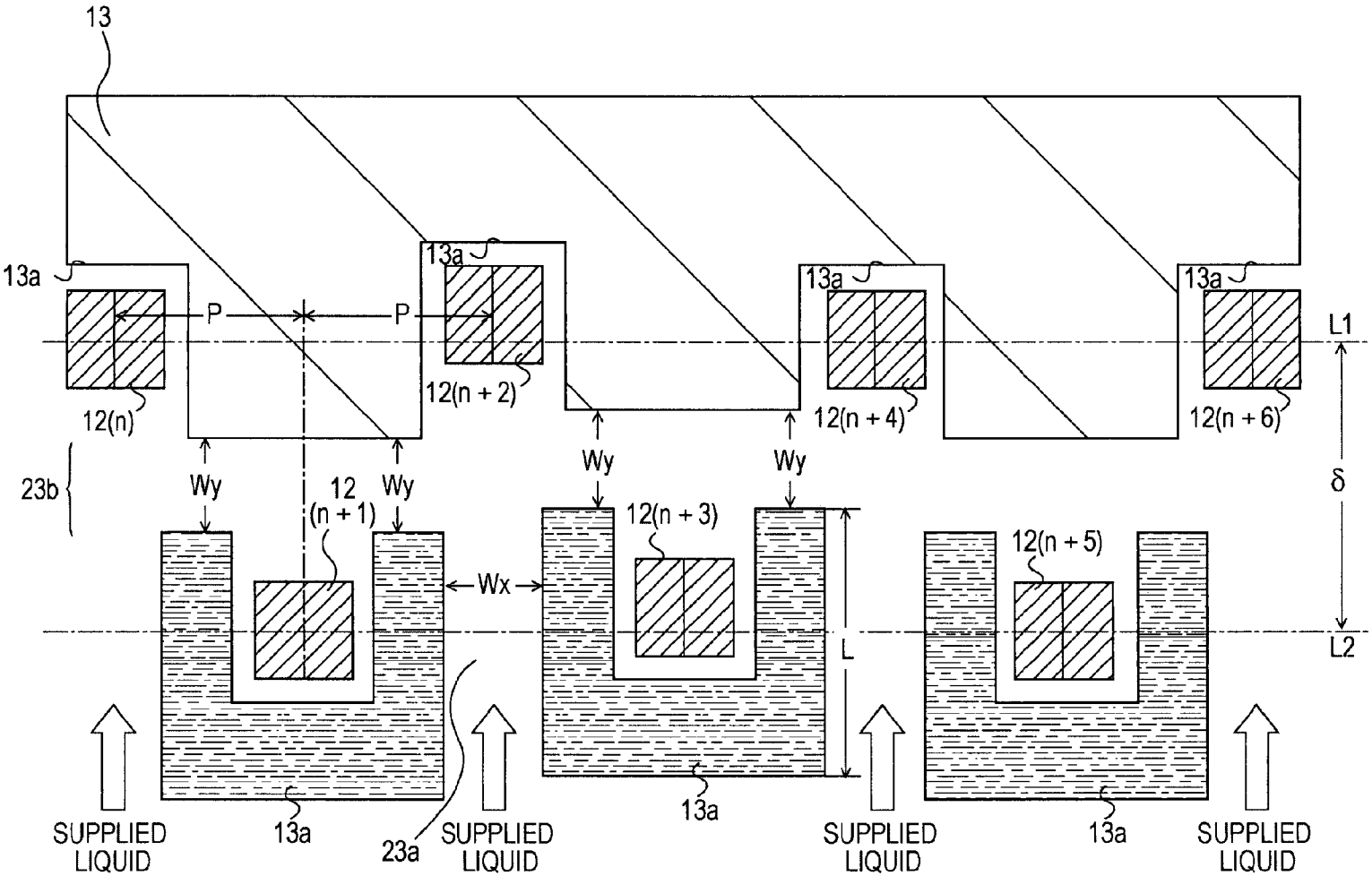
FIG. 4 is a plan view showing a head chip according to another embodiment, which is a modification of that shown in FIG. 3.

FIG. 4 is a plan view of a head chip 19 according to another embodiment, which is a modification to the head chip 19 shown in FIG. 3. In the example shown in FIG. 3, all heating elements 12 are disposed such the center of each heating element 12 is exactly located on either line L1 or L2. On the other hand, in the example shown in FIG. 4, some heating elements 12 are disposed such that the center of each of these heating elements 12 is deviated from the line L1 or L2. In FIG. 4, of the heating elements 12, heating elements 12(n), (n+4), and (n+6) are disposed such that the center thereof is located exactly on the line L1.

However, of the heating elements 12, a heating element 12(n+2) is disposed such that its center is slightly deviated from the line L1. The amount of deviation is, for example, less than ±δ/5. Similarly, of the heating elements 12 located on the line L2, although heating elements 12(n+1) and (n+5) are disposed such that the center thereof is located exactly on the line L2, a heating element 12(n+3) is disposed such that its center is slightly deviated from the line L2. Also in this case, the amount of deviation is set to be, for example, less than ±δ/5.

As in the present example, the heating elements 12 do not necessarily need to be disposed such that the center thereof is located exactly on the line L1 or L2, but the center may be deviated within a predetermined small range. That is, the heating elements 12 on the line L1 may be disposed such that they are located alternately at positions exactly on the line L1 and positions slightly deviated from the line L1, and the heating elements 12 on the line L2 may be disposed such that they are located alternately at positions exactly on the line L2 and positions slightly deviated from the line L2, in a zigzag fashion.

Figure 5:
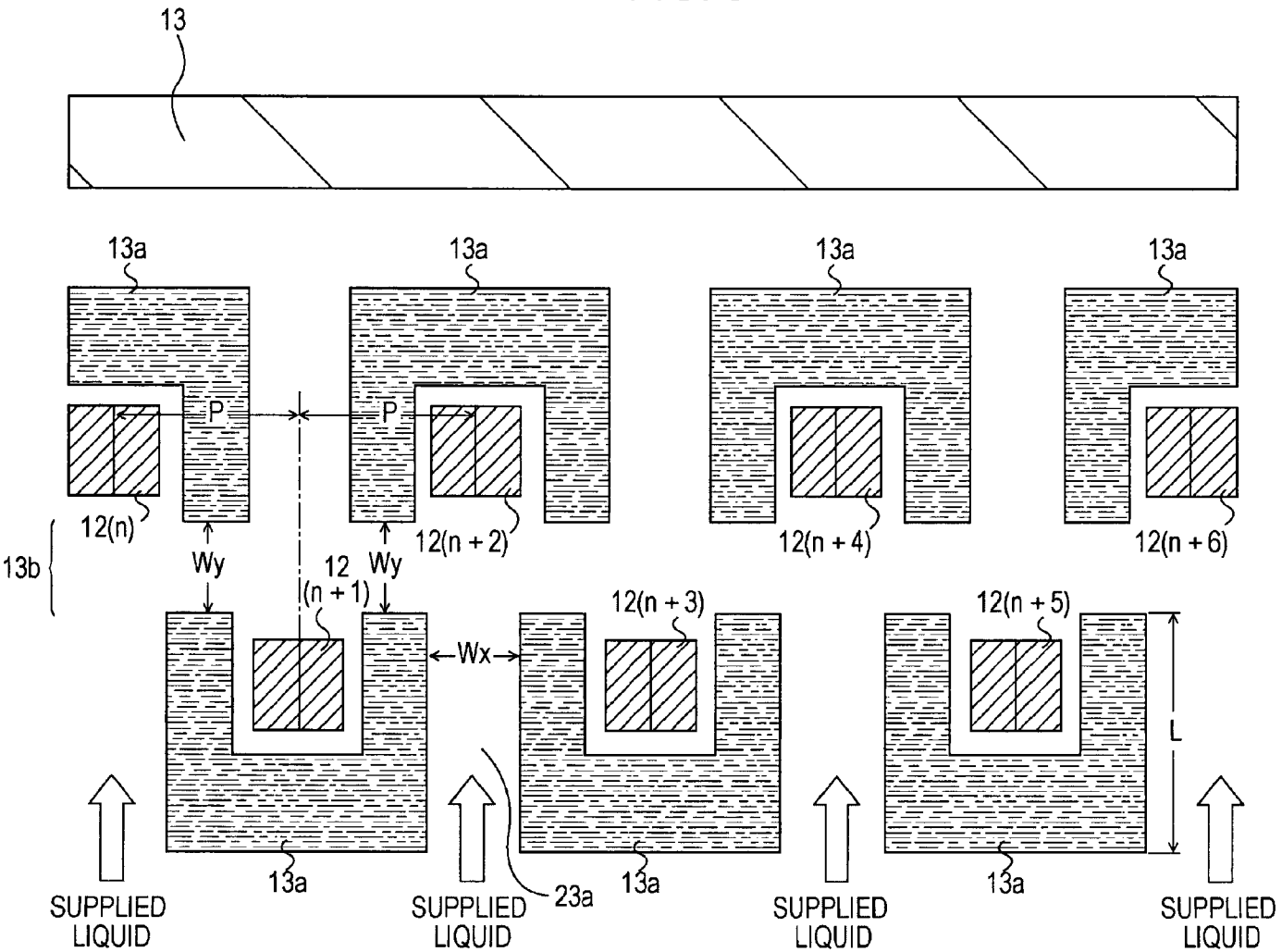
FIG. 5 is a plan view showing a head chip according to another embodiment, which is another modification of that shown in FIG. 3.

FIG. 5 is a plan view of a head chip 19 according to still another embodiment, which is a modification to the head chip 19 shown in FIG. 3. In the example shown in FIG. 3, the liquid chambers 13*a* in which one of the heating elements 12 on the line L1 is placed are integrally formed in the barrier layer 13*a*. In contrast, in the example shown in FIG. 5, liquid chambers 13*a* in which one of heating elements 12 on the line L1 is placed are formed such that they are isolated from each other, as with liquid chambers 13*a* in which one of heating elements 12 on the line L2 is placed.

In this structure, the open side of each liquid chamber 13*a*, which is substantially U-shaped in horizontal cross section, faces in a direction opposite to the direction in which an open side of another liquid chamber 13*a* at an opposite position faces. This structure allows reflection conditions of shock waves generated when liquid is ejected to become more similar for all liquid ejection elements than in the structure shown in FIG. 3 or 4, and also allows the nozzle sheet 17 to have a uniform tension distribution.

The flow channel structure according to the present embodiment has the following features.

(1) In regard to the strength, the structure has the following features.

Because the liquid ejection elements are disposed alternately on the lines L1 and L2 in the zigzag fashion, each group of liquid ejection elements located on either line L1 or L2 forms a head with a half resolution. Because the mechanical strength increases with decreasing resolution, the array of liquid ejection elements according to the present embodiment makes it possible to increase the mechanical strength.

In the liquid ejection elements arrayed in the zigzag fashion, the liquid chamber 13*a* of each of liquid ejection elements located on the line L1 or L2 has a substantially U-shaped form, and thus it is possible to achieve similar strength in all directions. Furthermore, because each liquid chamber 13*a* is disposed such that the open side thereof faces inward, when a pressure (surface pressure) is applied to an edge (of the array of liquid ejection elements) of the head chip 19, a strong outer part bears the applied pressure thereby protecting a weak inner part. That is, edges of open sides of the liquid chambers 13*a* are weakest in strength, but these weakest parts are disposed at inner positions facing each other such that they are protected by the outer parts. Thus, these inner parts are protected from a pressure which occurs when bonding to the nozzle sheet 17 is performed, and also from an outer pressure which is applied after the bonding to the nozzle sheet 17 is performed.

Furthermore, because the positions of the liquid chambers 13*a* located on the line L1 are shifted by P from the corresponding liquid chambers 13*a* located on the line L2, walls of liquid chambers 13*a* are located at positions facing, via the gap Wy, both sides of the opening of each liquid chamber 13*a*. This prevents the structure from being easily deformed when a pressure (surface pressure) is applied to the structure.

In the structure of the related technique, as with the head chip 1*a* (FIG. 12), in which long individual flow channels 3*d* are formed in a comb-like shape, a large stress occurs when a force is applied. In contrast, in the liquid chambers 13*a* according to the present embodiment, because each liquid chamber 13*a* is substantially U-shaped in horizontal cross section, and there is a beam extending in the direction in which liquid chambers 13*a* are arrayed, a large strength is achieved, which prevents a large stress from occurring even when a large external force is applied.

Figure 12:
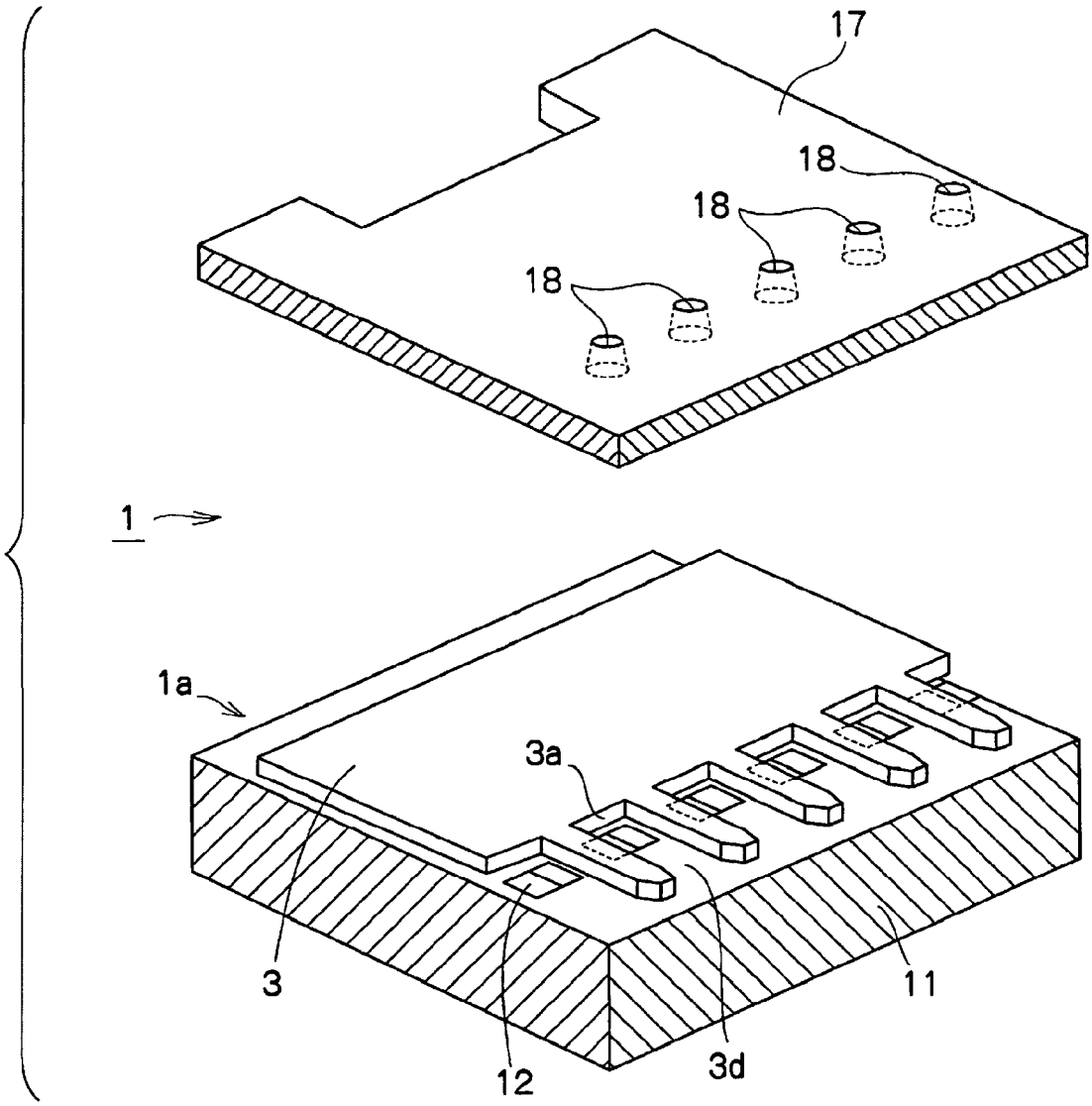
FIG. 12 is a perspective view showing the appearance of a convention liquid ejection head.

In the structure of the related technique, when the resolution is, for example, 600 DPI, heating element 12*s* are arrayed at intervals of about 42.3 μm, and the width of each comb finger formed, in the barrier layer 3, between each adjacent two heating element 12*s* is, at most, as small as about 15 to 17 μm as shown in FIG. 12. In contrast, in the structure according to the present embodiment, the thickness of the wall of each liquid chamber 13*a* can be as large as about 60 μm, which makes it possible to achieve sufficiently high strength. This allows the structure to withstand a lateral force (that is, each liquid chamber 13*a* can withstand strain due to a force in the direction in which heating elements 12 are arrayed).

(2) In many cases, head chips of the related techniques include a through-hole formed in the center of a semiconductor substrate, although not shown in FIG. 12. In contrast, in the structure according to the present embodiment, a flow channel is formed between each adjacent zigzag lines of heating element 12*s* (that is, between lines L1 and L2), but there is no flow channel (through-hole) formed through the semiconductor substrate 11. More specifically, the first common flow channels 23*a* and the second common flow channels 23*b* are formed in flat areas, where there is neither barrier layer 13 nor liquid chamber 13*a*, on the semiconductor substrate 11, and these flow channels do not have a part extending through the semiconductor substrate 11. Note that the common flow channel between each adjacent zigzag lines of heating element 12*s* may be in the form of a groove (having a substantially U-like shape in cross section), if it does not extend through the semiconductor substrate 11. Also note that a common flow channel in the form of a through-hole may be formed if the location thereof is not between adjacent zigzag lines of heating element 12*s*. For example, such a common flow channel in the form of a through-hole may be formed outside the area in which zigzag lines of heating element 12*s* are formed.

In designing of the head chip 19, having no flow channel in the form of a through-hole between zigzag lines of heating element 12*s* makes it possible to reduce the total size of the head chip 19. This allows a reduction in cost (because the cost directly depends on the area of the head chip 19). The head chip 19 needs a space for supplying liquid. The reduction in the size of the head chip 19 allows it to acquire the space for this purpose.

In the case in which a through-hole is formed in the semiconductor substrate as with the structure of the related technique, it is necessary to dispose driving circuit arrays separately on both sides of the through-hole. This results in an increase in the circuit size and thus an increase in the area of the head chip by a factor of about 2. Furthermore, it is necessary to dispose a large connection pad separately for each driving circuit array. This results in a further increase in the area. In contrast, in the structure according to the present embodiment, the heating element 12*s* located on the line L1 and the heating element 12*s* located on the line L2 are driven by a single electronic circuit (which will be described in detail later). Furthermore, in designing of the liquid supply system, the reduction in the size of the head chip 19 allows it to use a greater area for the liquid supply system, while reducing the total size of the line head 10.

(3) In the present embodiment, disposing heating elements 12 alternately on the lines L1 and L2 in the zigzag fashion makes it possible to have a great space between heating elements 12. That is, for example, regarding heating element 12*s* located on the line L1, the heating element 12*s* are disposed at intervals of 2P, which are twice the intervals needed to achieve the same resolution in the structure of the related technique. This brings about an increase in clearance regarding the physical dimension. For example, a head chip 19 with a resolution of 1200 DPI can be realized with a similar clearance to that needed to achieve 600 DPI in the structure of the related technique.

(4) In regard to liquid supply flow, the structure according to the present embodiment has the following features.

FIGS. 6A to 6D are schematic diagrams showing various structures of head chips. In these figures, squares drawn by solid lines represent liquid chambers, and circles drawn by dotted lines represent nozzles.

Figure 6A:
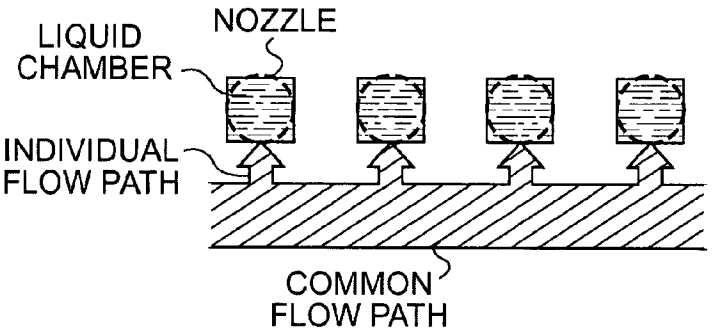
FIGS. 6A to 6D are schematic diagrams showing various structures for supplying liquid in a head chip.
Figure 6B:
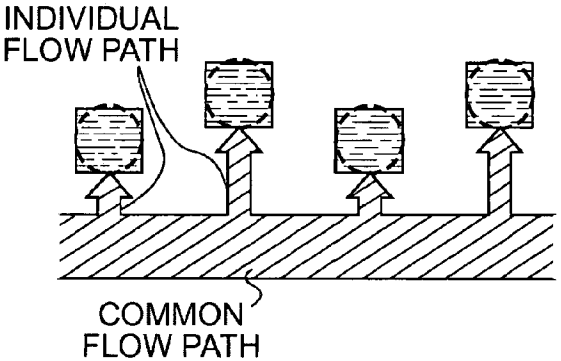
Figure 6C:
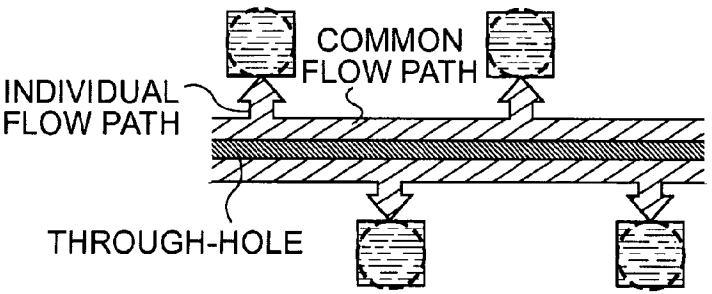
Figure 6D:
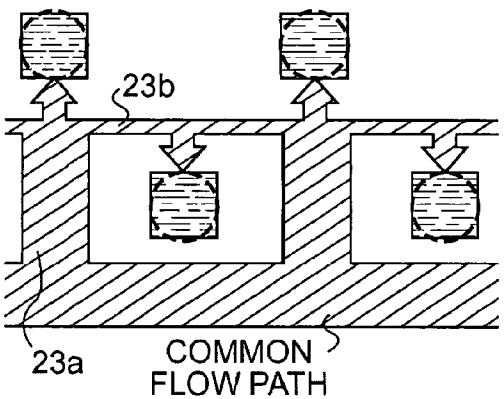

FIG. 6A shows a liquid flow in a structure of the related technique (such as that shown in FIG. 12). FIG. 6B shows a liquid flow in a structure proposed by the present applicant and filed as Japanese Patent Application No. 2003-383232. FIG. 6C shows a liquid flow in a structure having a through-hole formed between two zigzag lines of heating elements. FIG. 6D shows a liquid flow in the structure according to the present embodiment.

In the structures shown in FIGS. 6A to 6C, liquid is supplied to each liquid chamber via an individual flow channel. Therefore, in these structures, if an obstacle occurs in an individual flow channel, no liquid can be supplied to a corresponding liquid chamber.

In contrast, in the structure shown in FIG. 6D, liquid is supplied to each liquid chamber 13*a* from a plurality of directions via channels extending around that liquid chamber 13*a*. The liquid chambers 13*a* have a filter-like function that maintains the internal pressure of the liquid chambers 13*a*, and thus liquid supplied to openings of liquid chambers 13*a* and liquid supplied to openings of liquid chambers 13*a* at opposite locations are all supplied after being passed through the first common flow channel 23*a* with the width equal to Wx. As a result, liquid with substantially the same pressure is supplied to the openings of all liquid chambers 13*a* located on the lines L1 and L2.

(5) The flow channel structure according to the present embodiment can provide high uniformity in terms of characteristics of ejecting and refilling of liquid. The high uniformity is important because if the uniformity is not sufficiently high, an ejection variation or a variation in the amount of an ejected liquid droplet occurs when a liquid ejection operation is performed under a particular condition, or a bubble is generated owing to a difference in operation speed (generation of a bubble results in a great reduction in the amount of ejected liquid).

To reduce variations, it is needed to form the flow channel structure so as to have a symmetrical shape or a shape of rotational symmetry. In this regard, in the structure shown in FIG. 6B, differences in length from the common flow channel to respective liquid chambers can cause a variation in characteristics. In contrast, in the structure according to the present embodiment, liquid can be supplied to all liquid chambers 13*a* under similar conditions, and thus high uniformity can be achieved in terms of ejection and refilling characteristics of liquid ejection elements.

(6) When a nozzle sheet is separately prepared and the nozzle sheet is bonded to a semiconductor substrate on which heating elements and liquid chambers are formed, the small thickness (about 10 to 30 μm) of the nozzle sheet compared to the thickness (about 600 to 650 μm) of the head chip causes a tension to occur in the nozzle sheet at room temperature.

If a thermal stress or an external force is applied to such a structure, a change in the tension in the nozzle sheet occurs, and, as a result, a strain can occur. However, in the structure according to the present embodiment, the nozzle 18, which is a part most sensitive to a change in the tension, is surrounded by the substantially U-shaped wall of the liquid chamber 13*a*, and thus the tension does not cause a large stress to be applied to the nozzle 18. Therefore, it is possible to achieve high stability and high reliability over a wide temperature range.

(7) If the viscosity or the surface tension of liquid is low, a shock wave is generated when liquid is ejected, and a liquid surface vibration or a liquid pressure change occurs when liquid is refilled. It takes a long time for a meniscus to come to rest after such a shock wave is generated or a liquid surface vibration occurs. One method to prevent the above problem is to increase the length of the individual flow channel between each liquid chamber and the common flow channel such that the long individual flow channel has a large flow resistance thereby attenuating the shock wave generated when liquid is ejected and the vibration that occurs when liquid is refilled. However, if a bubble appears in the long individual flow channel, an ejection failure occurs. If the ejection operation is continued in such a state, there is a possibility that a heating element is broken.

To prevent the above problem, a column (a filter) for trapping dust or a particle is generally disposed in front of each individual flow channel, so that the filter has an effect of attenuating the vibrations or reduces interference.

In contrast, in the structure according to the present embodiment, the isolated and independent liquid chambers 13*a* facing the common flow channel 23 serve as filters. Filters of the related technique (such as filters 30 shown in FIG. 10) may be additionally disposed to achieve a double filtering effect. The filtering characteristics of the liquid chambers 13*a* can be optimized in terms of the ability of reducing interference and vibrations by properly selecting the gap Wx and the length L (FIG. 3) of each liquid chamber 13*a*.

In particular, when liquid chambers 13*a* are formed to be symmetric as shown in FIG. 5, the influence of shock waves can be minimized by forming flow channels (with a width equal to Wx) so as to extend straight from openings of liquid chambers 13*a* thereby absorbing shock waves propagating from the openings of the liquid chambers 13*a*.

(8) The length of a flow channel from a common flow channel to an individual flow channel and the flow resistance thereof influence the ejection pressure (ejection speed). In the present embodiment, liquids flow through channels on both sides of each liquid chamber 13*a* and join each other in the second common flow channel 23*b* located at the center between the liquid chambers 13*a* on the line L1 and the liquid chambers 13*a* on the line L2. The joined flow is divided and supplied to the respective liquid chambers 13*a* via paths with substantially the same length (same flow resistance). Therefore, even when the ejection operation is performed continuously, liquids can be ejected from liquid ejection elements at opposite locations at substantially the same ejection pressure (ejection speed).

Thus, the flow channel structure according to the present embodiment has the following advantages.

(1) A first advantage is that a failure due to a bubble can be suppressed. Even if a failure due to a bubble occurs, self-recovering from the failure can occur. In the present structure, because liquid is supplied from three directions to the opening of each liquid chamber 13*a*, a priming effect is always achieved.

(2) A very similar droplet ejection speed is obtained for all liquid ejection elements (that is, all liquid ejection elements have similar ejection characteristics).

(3) Because liquid ejection elements on the same line (the line L1 or L2) are located at large intervals, the wall of each liquid chamber 13*a* can be formed so as to have a sufficiently large thickness so that a change in characteristics due to a thermal expansion or a mechanical stress applied to the line head 10 is minimized.

(4) It is possible to reduce interference between ejection shocks generated by different liquid ejection elements (by large and uniform filtering effects).

(5) Because each liquid chamber 13*a* is surrounded by liquid with greater thermal conductivity than that of the barrier layer 13, a good heat removal characteristic can be achieved.

(6) Because the nozzle sheet 17 has a uniform tension distribution, variations in characteristics among nozzles 18 can be minimized.

(7) Because liquid is supplied to each liquid chamber 13*a* from three directions, a failure due to a particle or dust can be minimized.

(8) For the same resolution (DPI) and the same number of nozzles, the head chip 19 can be formed to have a smaller area than the area of the structure in which a through-hole is formed at the center of the head chip 19.

Now, ejection direction deflecting means according to the present embodiment is described below.

In the present embodiment, as shown in FIG. 3 and other figures, the heating element 12 located in each liquid chamber 13*a* is divided into two parts disposed side by side. Two parts of each heating element 12 are disposed side by side in the same direction as the direction in which the nozzles 18 are arrayed. Although the locations of nozzles 18 are not shown in FIG. 3, the nozzles 18 are disposed above the respective heating element 12*s* such that the central axis of each nozzle 18 is coincident with the central axis of a corresponding heating element 12 as a whole of the structure of the heating element 12 having two parts disposed inside one liquid chamber 13*a*.

In the case of the heating element 12 of the two-part type formed in the above-described manner, the length of each part of the heating element 12 is equal to the length of a non-divided heating element, and the width of each part is one-half the width of the non-divided heating element. Therefore, the resistance of each of the two parts of the heating element 12 is twice the resistance of the non-divided heating element. If the two parts of the heating element 12 is connected in series to each other, the resultant resistance becomes 4 times greater than the resistance of the non-divided heating element (note that the resistance is calculated without taking into account the effect of a space formed between the two parts).

To boil the liquid in the liquid chamber 13*a*, particular electrical power is applied to the heating element 12 to heat the heating element 12. The liquid is ejected by boiling energy. When the resistance of the heating element 12 is low, it is needed to pass a large current through the heating element 12. On the other hand, when the heating element 12 has a large resistance, it is possible to boil the liquid by passing a small current through the heating element 12.

This allows it is use a small-size transistor to supply a current to be passed through the heating element 12, and thus it is possible to reduce the total size. The resistance of the heating element 12 can be increased by reducing the thickness of the heating element 12. However, there is a lower limit on the thickness of the heating element 12, depending on the characteristics such as the strength (durability) of the material used to form the heating element 12. The dividing of the heating element 12 into two parts makes it possible to increase the resistance of the heating element 12 without reducing the thickness of the heating element 12.

In the structure in which a heating element 12 divided into two parts is disposed in each liquid chamber 13*a*, in general, two parts of each heating element 12 are heated such that temperatures thereof reach, at the same time, to a temperature needed to boil the liquid (that is, the two parts are heated such that the bubble generation time becomes the same for the two parts). If there is a difference in the bubble generation time between the two parts of the heating element 12, the liquid ejection angle is deviated from the vertical direction.

Figure 7:
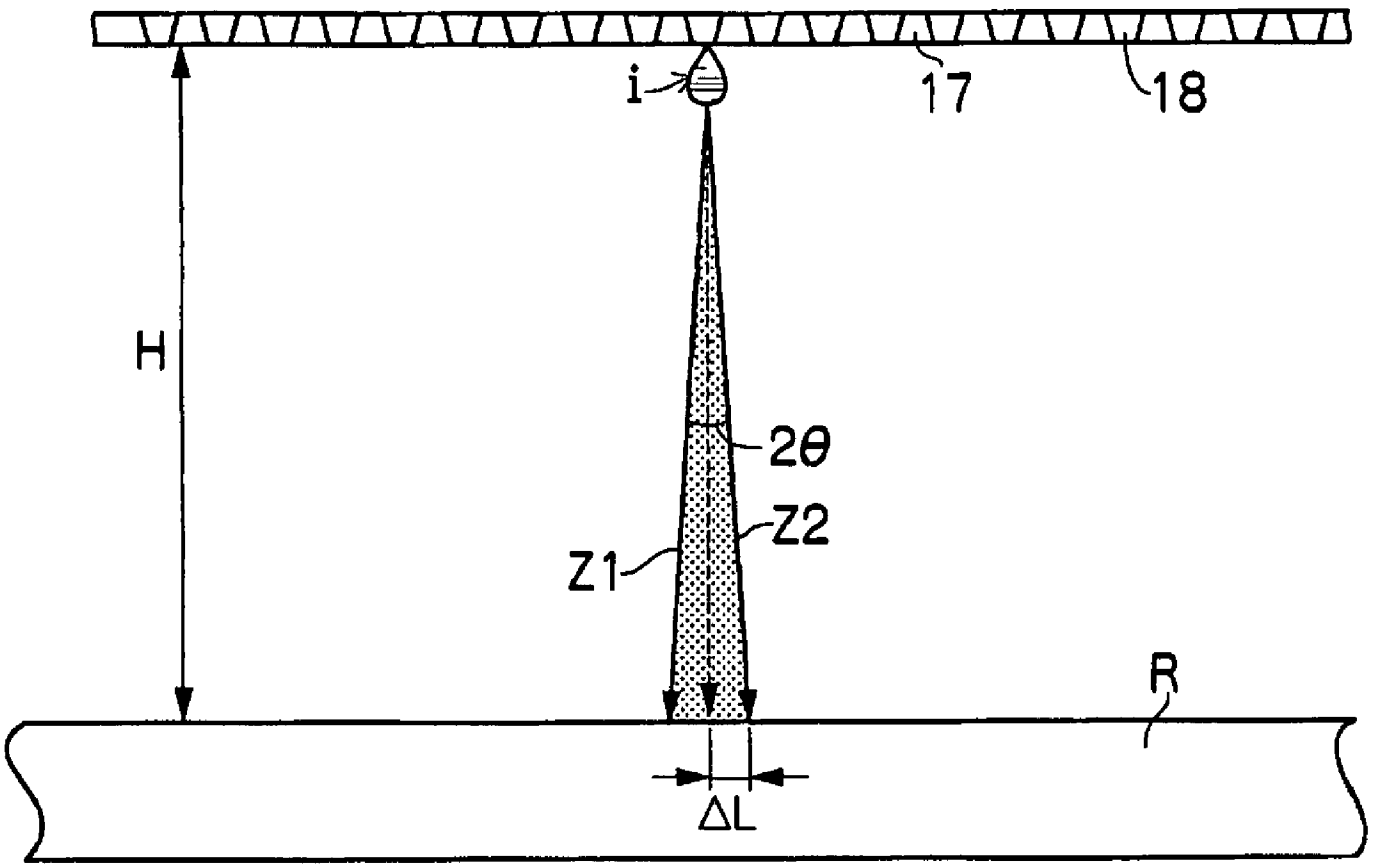
FIG. 7 is a diagram illustrating liquid ejection directions.

FIG. 7 is a diagram illustrating the liquid ejection angle. In FIG. 7, if liquid i is ejected in a direction perpendicular to a liquid ejection plane (surface of a recording medium R), the ejected liquid i travels along a straight path indicated by an arrow represented by a dotted line in FIG. 7. On the other hand, if the ejection angle of the liquid i is deviated by θ from the vertical direction, the ejected liquid i travels along a path Z1 or Z2, and thus the arrival point of the liquid i is deviated by $$\Delta L = H \times \tan\theta$$

where H is the distance between the end of the nozzle 18 and the surface of the recording medium R, that is, the distance between the liquid ejection surface of the liquid ejection element and the liquid arrival surface (this also holds in the following discussions). In common ink-jet printers, the distance H is in the range of 1 to 2 mm. In the following discussion, it is assumed that the distance H is maintained at a constant value equal to about 2 mm.

The distance H needs to be maintained constant because a change in the distance H results in a change in the arrival position of the liquid i. When the liquid i is ejected in a deflected direction from the nozzle 18 toward the surface of the recording medium R, the arrival position of the liquid i varies with the change in distance H, although the change in the distance H does not cause a change in the arrival position when the liquid i is ejected in the vertical direction.

Figure 8A:
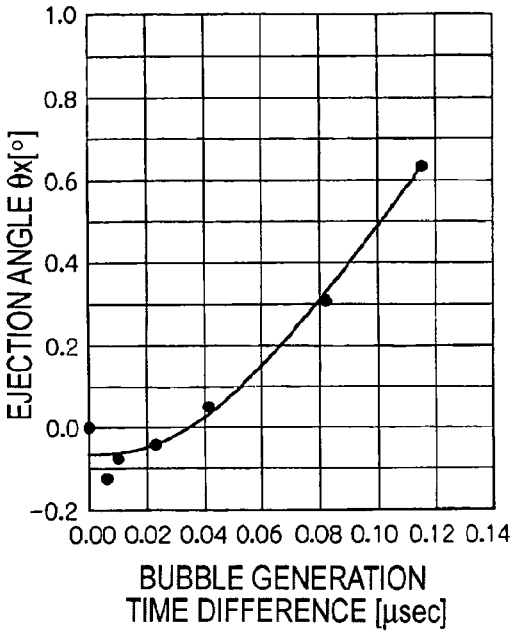
FIGS. 8A and 8B are graphs showing the liquid ejection angle as a function of a difference in bubble generation time between two parts of a heating element.
Figure 8B:
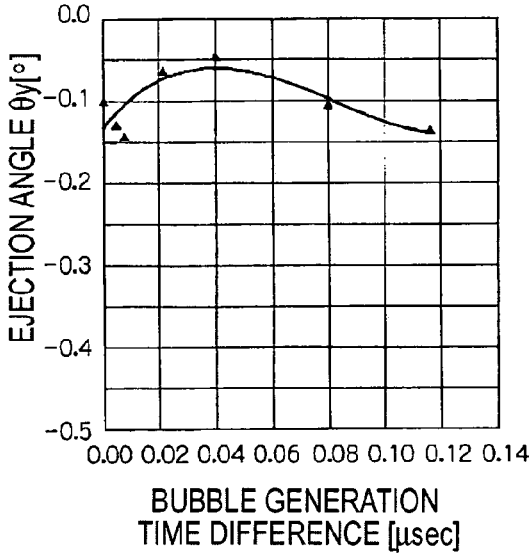
Figure 8C:
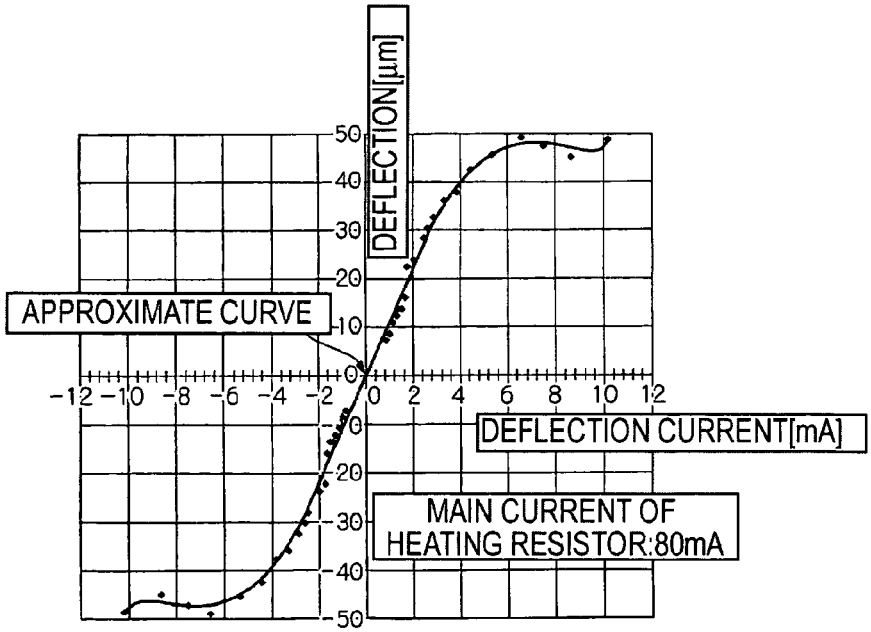
FIG. 8C is a graph showing measured deviations of liquid arrival position as a function of a deflection current passed through two parts of a heating element.

FIGS. 8A and 8B are graphs indicating results of computer simulations in terms of the liquid ejection angle as a function of the difference in time needed to generate a bubble in liquid between two parts of the heating element 12. Note that FIG. 8A shows the liquid ejection angle measured in an X direction, and FIG. 8B shows the liquid ejection angle measured in a Y direction, wherein the X direction is a direction in which the nozzles 18 are arrayed (the direction in which two parts of each heating element 12 are disposed side by side), and the Y direction is a direction (in which the recording medium is fed) perpendicular to the X direction. FIG. 8C shows measured deviations of the liquid arrival position. In this figure, a horizontal axis represents a deflection current defined as one-half the difference between currents flowing through the two parts of the heating element 12. Note that the deflection current corresponds to the bubble generation time difference between the two parts of the heating element 12. In FIG. 8C, a vertical axis represents the measured value of the deviation of the liquid arrival position (while maintaining the distance between the liquid ejection surface and the liquid arrival surface (the recording medium) at about 2 mm). In this measurement, a main current of 80 mA was passed through the heating element 12, and the deflection current described above was superimposed on the main current passed through one of the two parts of the heating element 12 thereby deflecting the liquid ejection direction.

When there is a difference in the bubble generation time between the two parts that are produced by dividing the heating element 12 in the direction in which the nozzles 18 are arrayed, the liquid ejection angle is deviated from the vertical direction as shown in FIGS. 8A and 8C. That is, the liquid ejection angle θx in the direction in which the nozzles 18 are arrayed increases with the bubble generation time difference (note that the liquid ejection angle θx indicates the deviation from the vertical direction and corresponds to θ in FIG. 7).

In the present embodiment, the heating element 12 divided into two parts is used, and currents are passed through the two parts of the heating element 12 such that there is a difference in the current between these two parts thereby creating a difference in the bubble generation time between the two parts of the heating element 12. By controlling the difference in the current between the two parts of the heating element 12, the ejection direction of the liquid ejected from each nozzle 18 is deflected by a desirable amount in the direction in which the liquid ejection elements (nozzles 18) are arrayed.

When there is a difference in resistance between the two parts of the heating element 12 because of a production error or the like, a difference occurs in the bubble generation time between the two parts of the heating element 12. As a result, a deviation occurs in the liquid ejection angle from the vertical direction, which results in a deviation of the liquid arrival position from a correct position. The deviation of the liquid arrival position can be adjusted by properly controlling the currents passed through the two respective parts of the heating element 12 thereby adjusting the bubble generation times such that the bubble generation time becomes the same for the two parts of the heating element 12 and thus the liquid is ejected in the vertical direction.

In the line head 10, the deviation of the liquid ejection direction from the vertical direction can be adjusted on a head chip by head chip basis such that the respective head chips 19 as a whole eject liquid in the vertical direction.

It is also possible to adjust the liquid ejection angle for one or more particular liquid ejection elements in a head chip 19. For example, in a particular head chip 19, when the liquid ejection direction of a particular liquid ejection element is not parallel with the liquid ejection direction of the other liquid ejection elements, it is possible to adjust the liquid ejection direction of this particular liquid ejection element such that the liquid ejection direction becomes parallel with the liquid ejection direction of the other liquid ejection elements.

It is also possible to deflect the liquid ejection direction as follows.

For example, let us assume that when liquids are ejected from a liquid ejection element N and an adjacent liquid ejection element N+1, the ejected liquids arrive at positions n and n+1, respectively, when the liquid ejection direction is not deflected. In this case, it is possible to deflect the ejection direction of liquid ejected from the liquid ejection element N such that the ejected liquid arrives at the arrival position n+1, instead of ejecting the liquid in the non-deflected direction such that the ejected liquid arrives at the arrival position n.

Similarly, it is possible to deflect the ejection direction of liquid ejected from the liquid ejection element N+1 such that the ejected liquid arrives at the arrival position n, instead of ejecting the liquid in the non-deflected direction such that the ejected liquid arrives at the arrival position n+1.

For example, when the liquid ejection element N+1 becomes impossible to eject liquid because of blocking or the like, it becomes impossible to have liquid deposited at the arrival position n+1, and a dot failure occurs. If the head chip 19 includes such a failed liquid ejection element, the head chip 19 as a whole is regarded as failed.

However, when such a failure occurs, it is possible to obtain liquid deposited at the arrival position n+1 by ejecting liquid in a properly deflected direction from the liquid ejection element N or N+2 adjacent to the liquid ejection element N.

A specific example of the ejection direction deflecting means is described below. This example of the ejection direction deflecting means according to the present embodiment is formed using current mirror circuits (hereinafter, referred to as CM circuits).

Figure 9:
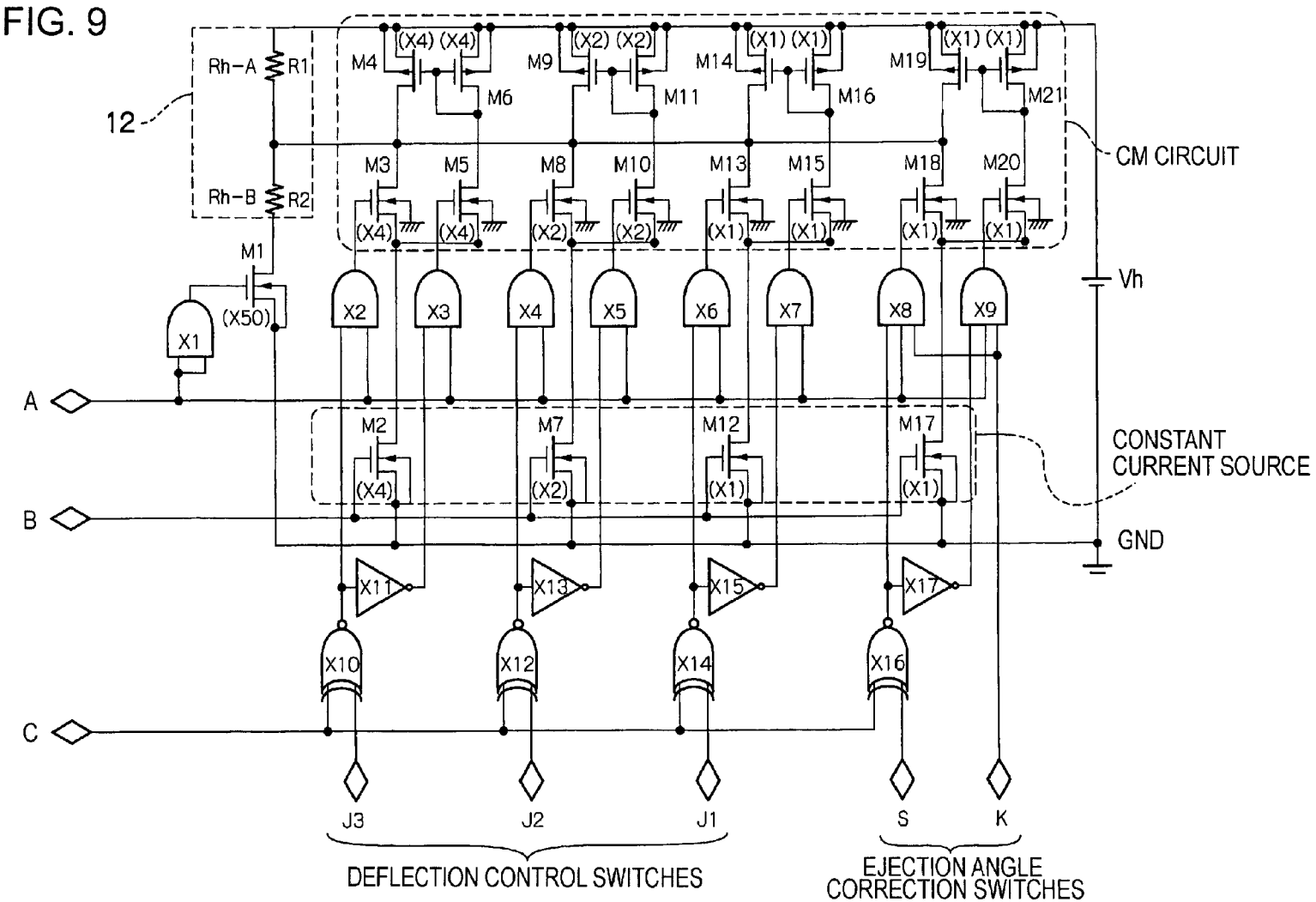
FIG. 9 is a circuit diagram of a specific example of ejection direction deflecting means according to an embodiment of the invention.

FIG. 9 is a circuit diagram showing a specific example of the ejection direction deflecting means according to the present embodiment. First, circuit elements used in this circuit and connections among them are described.

In FIG. 9, resistors Rh-A and Rh-B are resistors of the two respective parts of the heating element 12, and these two resistors are connected in series. A power supply Vh supplies a voltage to the resistors Rh-A and Rh-B.

The circuit shown in FIG. 9 includes transistors M1 to M21. Of these transistors, transistors M4, M6, M9, M11, M14, M16, M19, and M21 are PMOS transistors, while the other transistors are NMOS transistors. In the circuit shown in FIG. 9, a CM circuit is formed, for example, by transistors M2, M3, M4, M5, and M6, and a total of four CM circuits are formed in a similar manner.

In this circuit, the gate and the drain of the transistor M6 are connected to the gate of the transistor M4. The drains of the transistors M4 and M3 are connected to each other, and the drains of the transistors M6 and M5 are connected to each other. Transistors are connected in a similar manner in the other CM circuits.

The drains of the transistors M4, M9, M14, and M19 of the respective CM circuits and the drains of the transistors M3, M8, M13, and M18 of the respective CM circuits are connected in common to the node between the resistors Rh-A and Rh-B.

The transistors M2, M7, M12, and M17 serve as constant current sources of the respective CM circuits, and the drains of respective these transistors are connected to the respective sources of the transistors M3, M8, M13, and M18.

The drain of the transistor M1 is connected in series to the resistor Rh-B. When an ejection execution switch A is at a "1"-level (on-level), the transistor M1 turns on, and, as a result, a current flows through the resistors Rh-A and Rh-B.

Output terminals of the respective AND gates X1 to X9 are connected to the respective gates of the transistors M1, M3, M5, M7, and M9. Note that the AND gates X1 to X7 are of the two-input type, but the AND gates X8 and X9 are of the three-input type. At least one of the input terminals of each of the AND gates X1 to X9 is connected to the ejection execution switch A.

One of input terminals of each of XNOR gates X10, X12, X14, and X16 is connected to a deflection direction selection switch C, and the other input terminal of each of these XNOR gates is connected to one of deflection control switches J1 to J3 or an ejection angle adjustment switch S.

The deflection direction selection switch C is a switch for switching a direction in which the liquid ejection direction is deflected, between positive and negative directions along the array of nozzles 18. If the deflection direction selection switch C is at the "1"-level (on-level), one of input terminals of the XNOR gate X10 is at the "1"-level.

The deflection control switches J1 to J3 are switches for determining the amount of deflection of the liquid ejection direction. For example, when the input terminal J3 is at a "1"-level (on-level), one of the input terminals of the XNOR gate X10 is at the "1"-level.

The output terminal of each of the XNOR gates X10, X12, X14, and X16 is connected to one input terminal of one of the AND gates X2, X4, X6, and X8 and also connected to one input terminal of one of the AND gates X3, X5, X7, and X9 via one of NOT gates X11, X13, X15, and X17. One input terminal of each of the AND gates X8 and X9 is connected to an ejection angle adjustment switch K.

The deflection amplitude control terminal B is a terminal for determining the amplitude of one deflection step by determining the current of the transistors M2, M7, M12, and M17 serving as constant current sources of the respective CM circuits. To this end, the deflection amplitude control terminal B is connected to the gates of the respective transistors M2, M7, M12, and M17. If 0 V is applied to this terminal, the current of each constant current source is set to be equal to 0, and thus no deflection flows. As a result, the amplitude of deflection becomes equal to 0. If the voltage applied to the deflection amplitude control terminal B is gradually increased, the current of the constant current source gradually increases, and thus the deflection current also gradually increases. As a result, the deflection amplitude increases. Thus, it is possible to properly control the deflection amplitude by controlling the voltage applied to the deflection amplitude control terminal B.

The source of the transistor M1 connected to the resistor Rh-B and the sources of the respective transistors M2, M7, M12, and M17 serving as the constant current sources of the respective CM circuits are grounded.

In the circuit diagram shown in FIG. 9, numerals "xN" (N=1, 2, 4, or 50) described in parentheses close to the respective transistors M1 to M21 indicate the number of transistor elements that are connected in parallel. For example, transistors with numerals "x1" (transistors M12 to M21) are each formed to have one standard transistor element. On the other hand, transistors with numerals "x2" (transistors M7 to M11) are each equivalent to a parallel connection of two standard transistor elements. Similarly, transistors with numeral "xN" are each equivalent to a parallel connection of N standard transistor elements.

The transistors M2, M7, M12 and M17 are respectively x4", "x2", "x1", and "x1" in the number of standard transistor elements, and thus, the ratio of the drain current among these transistors is 4:2:1:1 when a particular voltage is applied between the gate of each of these transistors and the ground.

The operation of the circuit is described. First, the operation of the CM circuit composed of the transistors M3, M4, M5, and M6 is discussed.

The ejection execution switch A is turned on only when liquid is ejected.

For example, when the signal levels are such that A="1" (that is, A is at the "1"-level (signal levels will be described in a similar manner also for other signals)), B=2.5 V, C="1", and J3="1", the signal level of the output of the XNOR gate X10 becomes "1". This "1"-level output signal and A="1" are input to the AND gate X2, and thus a "1"-level signal is output from the AND gate X2. As a result, the transistor M3 is turned on.

When the output of the XNOR gate X10 is at "1", the output of the NOT gate X11 is at "0". This "0"-level output signal and A="1" are input to the AND gate X3, and thus a 0-level signal is output from the AND gate X3. As a result, the transistor M5 is turned off.

Because the drains of the transistors M4 and M3 are connected to each other, and the drains of the transistors M6 and M5 are connected to each other, when the transistor M3 is in the on-state and the transistor M5 is in the off-state as described above, no current flows from the transistor M6 to the M5 although a current flow from the transistor M4 to the transistor M3. Because of the nature of the CM circuit, when no current flows through the transistor M6, the transistor M4 also has no current flowing therethrough. Because 2.5 V is applied to the gate of the transistor M2, a current corresponding to the applied voltage of 2.5 V flows only from the transistor M3 to the transistor M2 among the transistors M3, M4, M5, and M6.

In this state, because the gate of the transistor M5 is in the off-state, no current flows through the transistor M6, and thus no current flows through the transistor M4 that is a mirror of the transistor M6. The same current $I_h$ flows through both the resistors Rh-A and Rh-B if there is no other current. However, when the gate of M3 is in the on-state, the current determined by M2 is drawn via M3 from the node between the resistors Rh-A and Rh-B, and thus the current determined by M2 is added only to the current flowing through the resistor Rh-A.

Thus, $I_{Rh\text{-}A}>I_{Rh\text{-}B}$.

The operation of the circuit has been described above for the case in which C="1". When C="0", that is, when only the signal level of the deflection direction selection switch C is changed while maintaining the other signal levels (that is, the signals levels of A, B, and J3 are maintained at "1"), the circuit operates as follows.

When C="0" and J3="1", a "0"-level signal is output from the XNOR gate X10. This "0"-level output signal and A="1" are input to the AND gate X2, and thus the output level of the AND gate X2 becomes "0". As a result, the transistor M3 is turned off.

When the output signal level of the XNOR gate X10 is "0", the output signal level of the NOT gate X11 becomes "1". This "1"-level output signal and A="1" are input to the AND gate X3, and thus the transistor M5 is turned on.

When the transistor M5 is in the on-state, a current flows through the transistor M6. In this state, by the nature of the CM circuit, a current also flows through the transistor M4.

Thus, currents flow from the power supply Vh into the resistor Rh-A, the transistor M4, and the transistor M6. The current flowing through the resistor Rh-A all flows directly into the resistor Rh-B (any part of the current flowing out of the resistor Rh-A does not flow into the transistor M3, because the transistor M3 is in the off-state). All current passing through the transistor M4 flows into the resistor Rh-B, because the transistor M3 is in the off-state. The current passing through the transistor M6 flows into the transistor M5.

When C="1", as described earlier, the current flowing out of the resistor Rh-A partially flows into the resistor Rh-B and the remaining current flows into the transistor M3. In contrast, when C="0", the sum of the current passing through the resistor Rh-A and the current passing through the transistor M4 flows into the resistor Rh-B. As a result, the current $I_{Rh\text{-}A}$ flowing through the resistor Rh-A is smaller than the current $I_{Rh\text{-}B}$ flowing through the resistor Rh-B, that is, $I_{Rh\text{-}A}<I_{Rh\text{-}B}$. The ratio of these currents is inverse for C="1" and C="0".

By controlling the currents such that the current flowing through the resistors Rh-A and Rh-B become different from each other, it is possible to create a difference between times at which bubbles are generated on the respective two parts of the heating element 12 thereby deflecting the liquid ejection direction.

Depending on whether C="1" or C="0", the liquid ejection direction is deflected by the same amount but in opposite direction along the array of nozzles 18.

In the above discussion, only the deflection control switch J3 is turned on or off. If the deflection control switches J2 and J1 are turned on or off, it is possible to control the currents flowing through the resistors Rh-A and Rh-B more precisely.

More specifically, the current flowing through the transistors M4 and M6 can be controlled by the deflection control switch J3, the current flowing through the transistors M9 and M11 by the deflection control switch J2, and the current flowing through the transistors M14 and M16 by the deflection control switch J1.

As described earlier, the transistors M4 and M6, the transistors M9 and M11, and the transistors M14 and M16 have relative current driving capacities of 4, 2, and 1. Therefore, it is possible to control the deflection of the liquid ejection direction at one of eight levels by setting the three bits corresponding to the respective deflection control switches J1 to J3 to one of values (J1, J2, J3)=(0, 0, 0), (0, 0, 1), (0, 1, 0), (0, 1, 1), (1, 0, 0), (1, 0 1), (1, 1, 0) and (1, 1, 1).

By changing the voltage applied between the gates of the transistors M2, M7, M12 and M17 and the ground thereby changing the current flowing through these transistors, it is possible to change the amount of deflection per step while maintaining the ratio of the drain currents of transistors at 4:2:1.

Furthermore, as described earlier, according to the signal level of the deflection direction selection switch C, the deflection of the ejection direction is switched between two opposite directions along the direction in which the nozzles 18 are arrayed, while maintaining the amount of deflection.

In the line head 10, as shown in FIGS. 2A and 2B, a plurality of head chips 19 are arrayed in a zigzag fashion in a direction across the width of a recording medium, such that the orientation of the head chips 19 becomes opposite between each two adjacent head chips 19 (the orientation is inverted from one head chip 19 to another). In this array of head chips 19, if common signals are sent to the deflection control switches J1 to J3 of two adjacent head chips 19, the liquid ejection direction is deflected in opposite directions for the two adjacent head chips 19. In the present embodiment, to avoid the above problem, the deflection direction selection switches C of the respective head chips 19 are controlled such that the deflection direction is properly switched.

More specifically, in the line head structure in which a plurality of head chips 19 are arrayed in the zigzag fashion, C is set to be "0" for head chips 19 at even-numbered locations (N N+2, N+4, . . . ) and C is set to be "1" for head chips 19 at odd-numbered locations (N+1 N+3, N+5, . . . ) such that the deflection direction becomes the same for all head chips 19 of the line head 10.

The ejection angle adjustment switches S and K are similar to the deflection control switches J1 to J3 in that they are used to control deflection of the liquid ejection direction, but different in that they are used to adjust the deflection.

More specifically, the ejection angle adjustment switch K is used to specify whether the adjustment is performed or not. When K="1", adjustment is performed, but adjustment is not performed when K="0".

The ejection angle adjustment switch S is used to specify which direction along the array of nozzles 18 to perform adjustment.

For example, when K="0" (no adjustment is performed), 0"-level signal is applied to one of thee inputs of the AND gate X8 and one of three inputs of the AND gate X9, and thus the output signal level becomes 0 for both AND gates X8 and X9. As a result, the transistors M18 and M20 are turned off, and thus the transistors M19 and M21 are also turned off. Thus, no change occurs in currents flowing through the resistors Rh-A and Rh-B.

On the other hand, when K="1", if S and C are set, for example, such that S="0" and C="0", the output level of the XNOR gate X16 becomes 1. Thus, input signals of ("1", "1", "1") are applied to the AND gate X8, and the output level thereof becomes "1". As a result, the transistor M18 is turned on. One of inputs signals applied to the AND gate X9 is inverted by the NOT gate X17, and the resultant "0"-level signal is input to the AND gate X9. Thus, the output level of the AND gate X9 becomes "0". As a result, the transistor M20 is turned off. Because the transistor M20 is in the off-state, no current flows through the transistor M21.

In this situation, by the nature of the CM circuit, the transistor M19 also has no current flowing therethrough. However, because the transistor M18 is in the on-state, a current is drawn from the node between the resistors Rh-A and Rh-B and flows into the transistor M18. This causes the resistor Rh-B to have a smaller current flowing therethrough than the current flowing through the resistor Rh-A. Thus, by adjusting the liquid ejection angle, it is possible to adjust the arrival position of a liquid droplet by a desirable amount in the direction in which nozzles 18 are arrayed.

Although in the above-described example, the adjustment is controlled by a two-bit control signal given by the ejection angle adjustment switches S and K, the number of bits (that is, the number of switches) may be increased to perform the adjustment more precisely.

The deflection current Idef that determines the deflection of the liquid ejection direction can be represented as a function of the signal levels of the respective switches J1 to J3 and S and K as follows.

$$\begin{aligned} Idef &= J3\times 4\times Is + J2\times 2\times Is + J1\times Is + S\times K\times Is \\ &= (4\times J3 + 2\times J2 + J1 + S\times K)\times Is \end{aligned} \tag{1}$$

In equation (1), J1, J2, and J3 take a value of +1 or −1, S takes a value of +1 or −1, and K takes a value of +1 or 0.

As can be seen from equation (1), it is possible to set the deflection current at one of eight levels by setting J1, J2, and J3, and the deflection current is also set by S and K independently of J1 to J3.

Because the deflection current can be set at one of eight levels including four positive levels and four negative levels, it is possible to deflect the liquid ejection direction in either direction along the array of nozzles 18. For example, in FIG. 7, it is possible to deflect the liquid ejection direction by θ to the left from the vertical direction (such that the liquid is ejected in the direction Z1 in FIG. 7), and it is also possible to deflect the liquid ejection direction by θ to the right from the vertical direction (such that the liquid is ejected in the direction Z2 in FIG. 7). The value of θ, that is the amount of deflection, can be set arbitrarily.

EXAMPLES

Specific examples are described below.

Figure 10:
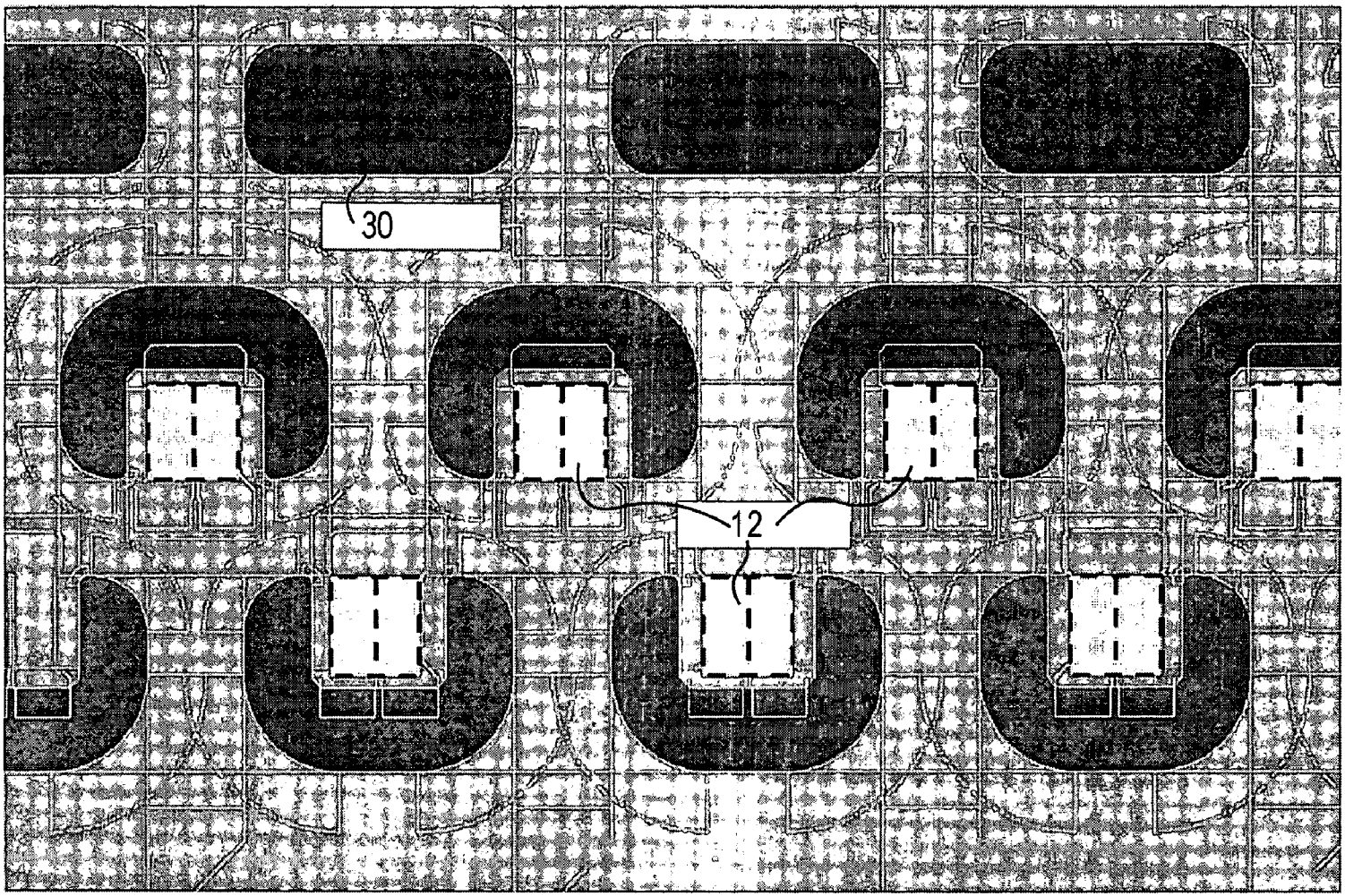
FIG. 10 is a diagram showing a part of a semiconductor processing mask according to an embodiment of the invention.

FIG. 10 shows a part of a semiconductor processing mask according to an embodiment of the present invention. In the example shown in FIG. 10, the semiconductor processing mask is designed so as to produce liquid chambers 13*a* with a symmetric shape such as those shown in FIG. 5 and so as to produce rectangular-column filters 30 at regular intervals of 2P at locations corresponding to the locations of respective liquid chambers 13*a* disposed in a lower line in FIG. 10. In FIG. 10, liquid is supplied from the upper side (where filters 30 are disposed), and the barrier layer 13 is located on the lower side. In the mask pattern shown in FIG. 10, locations of the heating element 12*s* are additionally shown by dotted lines. The intervals P of heating element 12*s* are set to 42.3 μm to obtain a resolution of 600 DPI. In FIG. 10, the distance (corresponding to δ in FIG. 3 or 4) in the vertical direction between two adjacent center lines of the array of heating element 12*s* is set to a value equal to P, that is, 42.3 μm.

Figure 11:
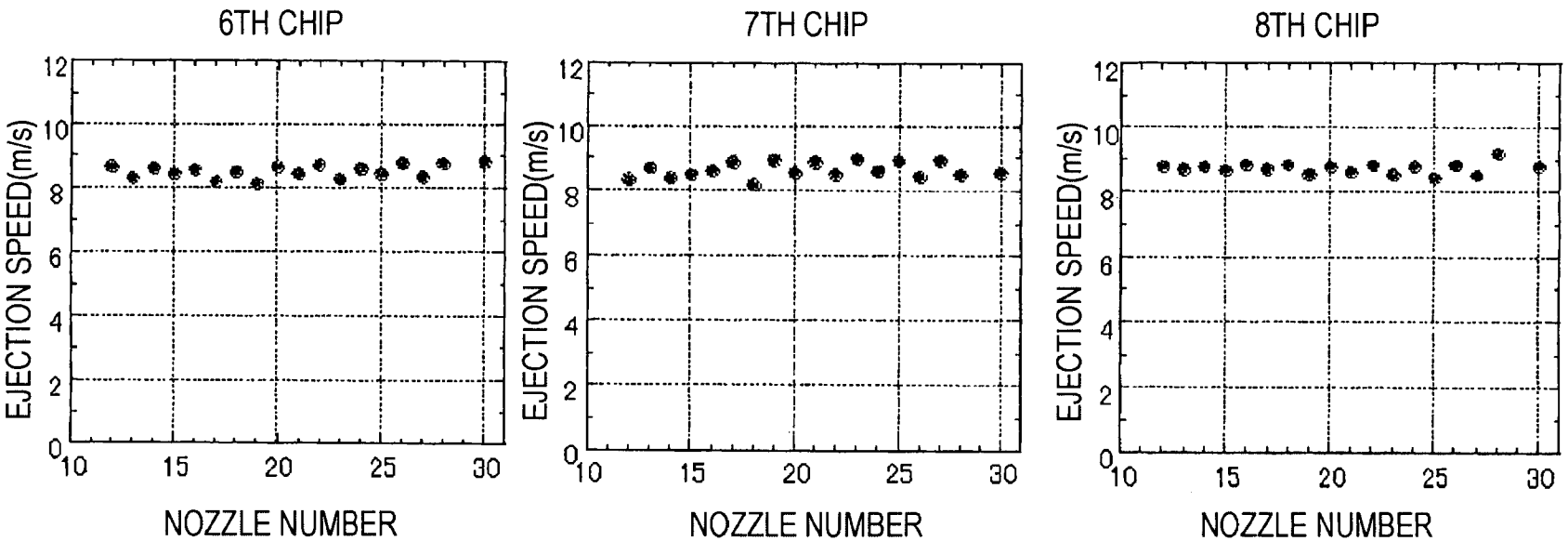
FIG. 11 shows results of ejection speed measurements for a liquid ejection head according to an embodiment of the invention.

FIG. 11 shows, in the form of graphs, measured ejection speed for eighteen nozzles 18 (liquid ejection elements) of three head chips 19 (sixth chip, seventh chip, and eighth chip) at successive locations in the line head 10 including sixteen head chips for each color, wherein each head chip 19 includes 320 nozzles.

The average ejection speed was 8.64 (m/s), and the standard deviation was as small as 0.21 (m/s). The small standard deviation of the measured ejection speed indicates that the line head according to the present embodiment has high stability and high accuracy in liquid ejection.

The bubble generation rate was experimentally evaluated as follows.

Line heads, which are different in structure of the liquid chamber 13*a* but which are identical in the intervals P of nozzles 18 and the average distance between the end of the head chip 19 the line of nozzles 18, were prepared.

The measured bubble generation rate for the structure of the related technique was about 1 to $1.5\times10^{-5}$.

On the other hand, the bubble generation rate for the structure according to the present embodiment was zero in any of a plurality of measurements (at an ambient temperature of 25° C.). The measurement shows that the line head according to the present embodiment also has high performance in terms of the bubble generation rate. In the actual printing test on A4-size paper, no degradation in image quality due to generation of bubbles was observed. In both the bubble generation rate measurement and the actual printing test, it was shown that the bubble generation rate was extremely low.

It should be understood by those skilled in the art that various modifications, combinations, sub-combinations and alterations may occur depending on design requirements and other factors insofar as they are within the scope of the appended claims or the equivalents thereof.

What is claimed is:

1. A liquid ejection head comprising a plurality of liquid ejection elements arrayed in a flat area on a substrate, each liquid ejection element including:

a liquid chamber for holding a liquid to be ejected;

a heating element disposed in the liquid chamber, for generating a bubble in the liquid in the liquid chamber by heating the liquid; and a nozzle for ejecting the liquid in the liquid chamber when the bubble is generated by the heating element, wherein, of the plurality of heating elements, heating elements at M-th positions as measured from an end of the array of heating elements are disposed such that the center of each of these heating elements is located exactly on or close to a first line extending in the same direction as the direction in which the heating elements are arrayed, while heating elements at N-th positions as measured from the end of the array of heating elements are disposed such that the center of each of these heating elements is located exactly on or close to a second line extending in the same direction as the direction in which the heating elements are arrayed, the first and second lines being parallel with each other and being spaced from each other by δ (real number greater than 0), Ms being odd or even numbers, Ns being even numbers if Ms are odd numbers or odd numbers if Ns are even numbers;

each liquid chamber is formed to have a U-like shape in horizontal cross section such that a wall thereof surrounds three sides of a heating element disposed in the liquid chamber;

the heating elements are arrayed such that the heating elements disposed on or close to the first and second lines are located, as a whole of heating elements, at regular intervals of P;

the liquid chambers are disposed such that an open side of each liquid chamber whose wall surrounds three sides of one of heating elements located exactly on or close to the first line faces in a direction opposite to a direction in which an open side of each liquid chamber whose wall surrounds three sides of one of heating elements located exactly on or close to the second line faces;

a gap Wx (real number greater than 0) is formed at least between each adjacent liquid chambers disposed at intervals of 2P on or close to the first line or between each adjacent liquid chambers disposed at intervals of 2P on or close to the second line such that adjacent liquid chambers are spaced from each other by the gap Wx in the direction in which the liquid chambers are arrayed;

a gap Wy (real number greater than 0) is formed between the liquid chambers disposed on or close to the first line and the liquid chambers disposed on or close to the second line such that the liquid chambers disposed on or close to the first line are spaced by the gap Wy from the liquid chambers disposed on or close to the second line in a direction perpendicular to the direction in which the liquid chambers are arrayed; and flow channels each having a width equal to Wx are formed by the gaps Wx, and a flow channel having a width equal to Wy is formed by the gap Wy.

2. A liquid ejection head according to claim 1, wherein:

each of the liquid chambers arrayed on or close to the first line and the liquid chambers arrayed on or close to the second line are formed so as to have a structure isolated from the other liquid chambers; and gaps Wx are formed on both sides of each liquid chamber such that adjacent liquid chambers are spaced from each other in the same direction as the direction in which the liquid chambers are arrayed.

3. A liquid ejection head according to claim 1, wherein positions of the heating elements arrayed on or close to the first line and positions of the heating elements arrayed on or close to the second line are shifted by P in the same direction as the direction in which the heating elements are arrayed such that each of the heating elements on or close to the first line is located at a position shifted by P relative to the position of a closest one of the heating elements on or close to the second line.

4. A liquid ejection head according to claim 1, wherein the plurality of liquid ejection elements are arrayed in parallel to and close to an outer longitudinal edge of the substrate.

5. A liquid ejection head according to claim 1, further comprising a common flow channel for supplying liquid to the liquid chambers of the respective liquid ejection elements, the common flow channel extending in the longitudinal direction of the substrate, the common flow channel being formed so as to extend through the substrate or so as to have a groove shape, wherein the first and second lines extend on one of sides of and in parallel with the common flow channel.

6. A liquid ejection head according to claim 1, further comprising ejection direction deflecting means for deflecting the ejection direction of liquid ejected from the nozzles of the liquid ejection elements in selected one of a plurality of directions along the direction in which the liquid ejection elements are arrayed, wherein in each liquid chamber, a plurality of heating elements are disposed side by side in the same direction as the direction in which the liquid ejection elements are arrayed; and the ejection direction deflecting means passes currents through the plurality of heating elements disposed in each liquid chamber such that the current passing through at least one of the plurality of heating elements is different at least from the current passing through one of the other heating elements thereby controlling the ejection direction of liquid ejected from the nozzle.

7. A liquid ejection apparatus having a liquid ejection head including a plurality of liquid ejection elements arrayed in a flat area on a substrate, each liquid ejection element including:

a liquid chamber for holding a liquid to be ejected;

a heating element disposed in the liquid chamber, for generating a bubble in the liquid in the liquid chamber by heating the liquid; and a nozzle for ejecting the liquid in the liquid chamber when the bubble is generated by the heating element, wherein, of the plurality of heating elements, heating elements at M-th positions as measured from an end of the array of heating elements are disposed such that the center of each of these heating elements is located exactly on or close to a first line extending in the same direction as the direction in which the heating elements are arrayed, while heating elements at N-th positions as measured from the end of the array of heating elements are disposed such that the center of each of these heating elements is located exactly on or close to a second line extending in the same direction as the direction in which the heating elements are arrayed, the first and second lines being parallel with each other and being spaced from each other by δ (real number greater than 0), Ms being odd or even numbers, Ns being even numbers if Ms are odd numbers or odd numbers if Ns are even numbers;

each liquid chamber is formed to have a U-like shape in horizontal cross section such that a wall thereof surrounds three sides of a heating element disposed in the liquid chamber;

the heating elements are arrayed such that the heating elements disposed on or close to the first and second lines are located, as a whole of heating elements, at regular intervals of P;

the liquid chambers are disposed such that an open side of each liquid chamber whose wall surrounds three sides of one of heating elements located exactly on or close to the first line faces in a direction opposite to a direction in which an open side of each liquid chamber whose wall surrounds three sides of one of heating elements located exactly on or close to the second line faces;

a gap Wx (real number greater than 0) is formed at least between each adjacent liquid chambers disposed at intervals of 2P on or close to the first line or between each adjacent liquid chambers disposed at intervals of 2P on or close to the second line such that adjacent liquid chambers are spaced from each other by the gap Wx in the direction in which the liquid chambers are arrayed;

a gap Wy (real number greater than 0) is formed between the liquid chambers disposed on or close to the first line and the liquid chambers disposed on or close to the second line such that the liquid chambers disposed on or close to the first line are spaced by the gap Wy from the liquid chambers disposed on or close to the second line in a direction perpendicular to the direction in which the liquid chambers are arrayed; and flow channels each having a width equal to Wx are formed by the gaps Wx and a flow channel having a width equal to Wy is formed by the gap Wy.

* * * * *